US005701873A

United States Patent [19]

Schneider

[11] Patent Number: 5,701,873

[45] Date of Patent: Dec. 30, 1997

[54] CONTROL DEVICE FOR A FILLING-RATIO ADJUSTING PUMP

[75] Inventor: Wolfgang Schneider, Oberglatt, Switzerland

[73] Assignee: Eidgenoessische Technische Hochschule Laboratorium Fuer Verbrennungsmotoren Und Verbrennungstechnik, Zurich, Switzerland

[21] Appl. No.: 464,856

[22] PCT Filed: Nov. 7, 1994

[86] PCT No.: PCT/CH94/00215

§ 371 Date: Jul. 10, 1995

§ 102(e) Date: Jul. 10, 1995

[87] PCT Pub. No.: WO95/13474

PCT Pub. Date: May 18, 1995

[30] Foreign Application Priority Data

Nov. 8, 1993 [CH] Switzerland ..... 3367/93

[51] Int. Cl.[6] ..... F02M 37/04; F02M 41/00

[52] U.S. Cl. ..... 123/516; 123/462

[58] Field of Search ..... 123/516, 510, 123/496, 462, 501, 500

[56] References Cited

U.S. PATENT DOCUMENTS 2,653,543 9/1953 Mott .
4,406,264 9/1983 Mowbray ..... 123/462
4,474,158 10/1984 Mowbray ..... 123/462
4,660,523 4/1987 Brauer ..... 123/462
5,094,216 3/1992 Miyaki ..... 123/496
5,115,783 5/1992 Nakamura ..... 123/496
5,197,441 3/1993 Green ..... 123/462
5,220,894 6/1993 Straubel ..... 123/496
5,479,899 1/1996 Phelps ..... 123/462

*Primary Examiner*—Carl S. Miller
*Attorney, Agent, or Firm*—Oblon, Spivak, McClelland, Maier & Neustadt, P.C.

[57] ABSTRACT

A control device for a filling-ratio adjusting pump with at least one displacement space works on the suction-throttle principle with a positive variation in volume of the displacement space or displacement spaces and is intended inter alia particularly for common-rail diesel injection systems. It allows an exact, precise and highly dynamic control of the filling-ratio adjusting pump at low outlay, without the system being impaired by undesirable cavitation. Located on the suction side of the pump is at least one throttling 2/2-way valve (21, 21*a*, 21*b*; 134; 51, 52, 53, 54; 81; 103) actuated by pressure difference. Either such a 2/2-way valve can be used for a group of displacement spaces or for the entire pump or a respective valve of this type can be inserted in front of each individual displacement space. The pressure-difference control of the or each 2/2-way valve takes place via an adjusting device (27; 150) which is arranged on the inflow side of the 2/2-way valve and which is designed either as a throttling valve or as a flow-regulating valve.

18 Claims, 17 Drawing Sheets

$V_{CYL}$
$P_{CYL}$ $=p_5$
$A_{VALVE}$
$P_{CHANNEL}$ $=p_3$
0
0
0
0
TDC
BDC
TDC
$V=V_{MAX}$
$P_{HIGH-PRESSURE}$ $=p_6$
$A_{VALVE}$ SUCTION ($V \rightarrow V_{MAX}$)
$P_{FEED}$ $=p_2$
$P_{CHANNEL}$ SUCTION ($V \rightarrow V_{MAX}$)

CONTROL DEVICE FOR A FILLING-RATIO ADJUSTING PUMP

TECHNICAL FIELD

The invention relates to a control device for a filling-ratio adjusting pump with at least one displacement space which works on the suction-throttle principle with a positive variation in volume of the displacement space or of the displacement spaces, which obtains the liquid to be conveyed from a liquid reservoir, having a free surface loaded with a gas pressure, usually atmospheric pressure, by means of a conduit or, if appropriate, via a hydraulic system, but without a supply of gas.

BACKGROUND ART

Filling-ratio adjusting pumps are hydrostatic pumps with a displacement effect by means of lifting pistons (for example, radial piston pump, axial piston pump, in-line pump) or rotary or pivoting piston pumps (for example, vane-cell pump, blocking-vane pump, roller-cell pump). The invention relates only to those filling-ratio adjusting pumps which work on the principle of suction throttling with a positive displacement movement. In these, a partial filling of the displacement space occurs as a result of a controlled cavitation in the compressed liquid. Both pistons with an oscillating movement and rotary displacers (vane-cell pump, blocking-vane pump, etc.) can be considered as positively moved displacers.

To increase the energy efficiency in hydrostatic systems, there has already long been the desire for an increased use of adjusting pumps. However, the currently obtainable designs of such adjusting pumps, which are mostly produced on the principle of stroke adjustment, are still too expensive for many uses or have too low an efficiency during part conveyance, that is to say at a low filling ratio.

At the same time, on account of the gain/cost ratio of the electronics which rises undiminished, there is a continuing trend towards the interlinking of electronics and fluid technology, so that there is a growing demand for a direct, but nevertheless cost-effective electrical control of adjusting pumps.

To be incorporated into regulating systems (in the form of actuating members), future adjusting pumps must have specific conveyed-stream characteristics and must reproduce these accurately, with low hysteresis and sufficient rapidity (that is to say, for example, without a long idle time). As is known, for actuating members in control loops, such properties are in part indispensable and in part at least of considerable advantage.

Furthermore, a high conveying uniformity of the individual displacers relative to one another is important, on the one hand on account of the noise generation and on account of any consumers relying on uniformity and, on the other hand, so that no additional disturbances of different frequency which could irritate a controller are carried into the high-pressure system.

Hydrostatic filling-ratio adjusting pumps of this type can be employed in many areas of use in vehicle, industrial, aeronautical and water hydraulics and, in particular, for general motor-vehicle hydraulics and the so-called common-rail diesel injection systems. By the use of the phase-control principle in such filling-ratio adjusting pumps (see the list of literature references at the end of the description), very high efficiencies can be achieved even during part conveyance and, in particular, even in the case of low-viscosity media, very high pressures and the lowest possible rotational speed. Particularly in contrast to this stroke-adjusting pump, in the phase-controlled pump, with a decreasing conveyed quantity per work cycle, there is also a reduction in the duration of pressure loading of the displacer bodies and the lost work associated with it (such as, for example, piston-gap leakage). This property of leakage insensitivity results, in addition to other reasons (see 2 and 4 of the list of literature references at the end of the description), in the particular suitability of such pumps for the common-rail diesel injection technique.

Such a reason is also the low consumption of energy or of force for the adjustment, since this frequently takes place via the adjustment of a throttle in the low-pressure part (U.S. Pat. No. 4,907,949). This also inter alia makes manual adjustment possible.

In principle, the low consumption of force also allows very high adjustment dynamics, so that the necessary adjustments can not only be rapidly calculated electronically, but the adjustments can be implemented by the use of high-speed components for electric direct drive. In view of the low forces, the size and production costs of the electric drives are likewise low. In general, low forces make it possible to regulate hydraulic/mechanical systems with a substantial absence of interaction between the correcting variable and the measurement signal.

An example of high adjustment dynamics required is, once again, the common-rail diesel injection system; the distributor tube (=common rail) and the other volumes carrying high pressure must be capable, in response to a signal from the engine electronics, of being pumped up very rapidly (an order of magnitude of 0.2 seconds when it is used in automobiles) to a considerably higher pressure. For this purpose, the conveyed quantity of the pump must be capable of being adjusted a further order of magnitude more rapidly—one pump work cycle is the minimum which can be achieved. This can be read up again in 4) of the list of literature references. Also, even when the pressure is constant, such a pump must be capable of providing other conveyed quantities within the order of magnitude of approximately two injections.

Other previous solutions, for example with individually controlled inlet valves, are too complicated particularly for pumps with a relatively large number of displacement spaces. It is a great advantage to make do with only one adjusting element for a large number of cylinders.

An example of a generic control device for filling-ratio adjusting pumps, which makes do with only one transducer element for a multiplicity of displacement spaces and has slit control on the inlet side and which is sufficient for many uses, is known from PCT/EP89/01057. A special flow guidance in the eccentric housing is intended to bring about a uniform filling of all the displacement spaces and therefore a high constant conveyance even during part conveyance sufficiently low for many uses. However, the dynamics are not adequate for various instances of use, since all the cylinders are filled from the central eccentric housing, and, during immediate transition to full conveyance, the latter first has to be filled by the throttle element and, in the reverse operation, has to be emptied, before a stationary state is reestablished in the filling and in the conveyed stream. However, surface and gravity effects can even then still generate sporadic local bubble accumulations with subsequent breakaway in groups, for example from walls, and this can lead to statistical conveyed-quantity dispersions and hysteresis effects during the operation of the pump. For example, states may be established, in which some displacement spaces receive more liquid and the other displacement spaces a higher cavity fraction during filling, conveyance thereby likewise becoming non-uniform.

The dynamics of a pump designed in a similar way to that in the abovementioned patent was measured by Faβbender (see 6 in the list of literature references). In this particular case, the conveyed stream lags behind the movement of the actuating member by an idle time of approximately 7 work cycles. A high-speed actuator alone is therefore insufficient. In the common-rail diesel injection technique already adopted as an example above, in this timespan the pressure in the distributor tube, because of its small volume, would already rise unacceptably and would be capable of being regulated only with difficulty.

A further example of a generic control device for a pump with inlet valves produced as non-return valves is known from CH 674,243=EP-A-299,337 which corresponds with U.S. Pat. No. 4,884,545. This published state of the art does not indicate any particulars regarding the pressures used. In tested pumps of this type, however, it was found that they suffer from cavitation during suction throttling, thereby generating considerable gas volumes which appreciably impair the desired accurate, precise and simple control.

In view of the cavitation during suction throttling with a positive displacement movement, the throttle-adjusting element was placed close to the displacement space in order to achieve the desired high dynamics. Consequently, at least in the radial-piston design, one transducer from each displacement space or a complicated mechanical linkage becomes necessary once again. The single-cylinder design was preferred, and either a multiple cam or a gear was proposed in order to achieve a higher volumetric flow and a higher pumping frequency. Apart from the construction and, if appropriate, load-related restrictions associated with this, such a solution having n cams or n drive transmission ratio relative to a pump having n cylinders results, it is true, in a high periodicity, that is to say a high similarity of the individual conveying trends, but also in a higher degree of interruption, considerably (n times) higher torque peaks in the drive, greater noise emissions as a result of (n times) deeper pressure rises in the cylinders and the risk that the process of the reentry of gas molecules from the cavities back into the liquid can no longer keep pace with the speed of the pressure rises (see 1 in the list of literature references) and cavitation damage can then occur under this condition.

The company Cooper Bessemer Corporation, Mt. Vernon, Ohio, USA, has for many years built a two-cylinder piston pump of the generic type for common-rail diesel injection systems. This pump possessed two cylinders, the adjusting throttle element being arranged between the two cylinders, so that the harmful spaces capable of being filled with cavities were minimal. Here too, the expansion to more than two cylinders is difficult and complicated. The position of the adjusting throttle element between the two cylinders restricts freedom in the displacer arrangement (radial, axial, in-line). This pump was, in turn, equipped with inlet slits, a satisfactory tightness of the displacement spaces obviously being achieved by a long-stroke design (that is to say, correspondingly large sealing lengths and smaller gap lengths), but this necessitated a correct crankshaft with cup tappets absorbing transverse forces and considerably increased the overall volume.

In conclusion, it may be said (in the first place) that a disadvantage is that there is even today the problem that, for optimum dynamics, exactness of the conveying characteristic and absence of hysteresis, these being properties particularly desirable when the pump is used in regulating systems, each displacement space has to be equipped with its own actuating element with drive or the actuating elements have to be connected to a central drive element by means of a complicated mechanism, along with the corresponding problems of quantity balancing. This conflict of aim between simplicity (as few actuating elements as possible or only one actuating element) and high dynamics, exactness of the conveying characteristic and absence of hysteresis comes to light all the more clearly when the individual displacement spaces are located far apart from one another, as, for example, in radial or in-line arrangements, or when there is a large number of displacement spaces. If the displacement spaces were located close to one another, as in axial-piston pumps, a central arrangement of an adjusting element would be fundamentally possible, but the constructional space is often too confined or is provided for other components.

The cause of these various restrictions in the use of the filling control by suction throttling with a positive displacement movement is founded in the cavitation which has hitherto been necessary for adjusting the conveyed quantity and which, on account of the ever-present turbulence sometimes desirable for the purpose of independence from viscosity, usually already commences in the throttling device and not only in the displacement spaces.

DISCLOSURE OF THE INVENTION

The object of the invention is, therefore, to provide a control device according to the preamble which can be produced cost-effectively and which, at a low outlay, can at least considerably contain the effect of this obstacle of premature cavitation and consequently, with general validity for different pump types of the displacement type, help to provide different greater degrees of freedom in the implementation of this actually extremely interesting and forward-looking conveyed-stream control. By the provision of degrees of freedom is meant that, from the point of view of production costs, of the abovementioned generally valid applicability to different pump types, overall size and the design of the pump as a whole, it is to be possible to combine actuating elements and, for example, actuate them directly from an electromechanical transducer as well as have the capability of arranging the adjustable elements at any location of the pump, without a significant impairment of the properties, or have the capability of placing them even at some distance from the pump, thus affording a remote-control possibility.

Cavitation in liquids in the case of stationary flows and the associated cavitation damage have often been investigated in the past. However, the non-stationary and virtually non-flowing case of cavitation in pump cylinders has hitherto been investigated to only a lesser extent. It is obvious, however, that, with materials customary in pump construction, damage caused by cavity breakdown is not to be expected. One of several reasons is possibly that the time is too short to dissolve out truly large gas or vapor quantities. Schweitzer (please see reference no. 5) in the list of literature references appearing hereinbelow) investigated the escape of dissolved gases out of liquids and found diffusion time constants which are well above typical work-cycle periods of hydrostatic pumps. Fassbender (reference no. 6) in the list of literature references) measured gas-outlet pressures, and these are actually very low for many relevant liquids.

The present invention makes use of these physical phenomena and of the further fact, better known per se, that liquid, which has been given time to become saturated in a gas atmosphere above pressure p1, for example at rest in a tank ventilated to the atmosphere, has a pronounced tendency, in the event of a shortfall of this pressure, above all when there is additionally also turbulence during the flow through or round an obstacle, to rid itself of the excess gas. This may be little in terms of mass, but nevertheless, in terms of volume, can fill a large part of a conduit or volume, thus necessitating, with respect to dynamics, the abovementioned filling-up or emptying operations, until a new stationary state is established.

To achieve the objects set above, according to the invention a control device is provided. The main characteristic of the invention is a preconnection of passive throttling valves, pressurized according to the rules of the claims, upstream of the individual displacement spaces, upstream of groups of displacers or the entire pump, thus ensuring that the pressure downstream of a throttle-actuating element to a point upstream of these valves does not at least essentially fall short of the pressure p1 of the liquid reservoir and preferably p1 plus an amount $\Delta_{pTemp}$ explained later, and consequently restricts an appreciable disruptive cavitation to the comparatively small volume downstream of these valves as far as the displacement spaces. This procedure is unusual, since throttlings with a loss of pressure in pumps are otherwise avoided as far as possible, for example by not pressurizing inlet valves at all or pressurizing them only slightly, in order to acquire some self-priming capability of the pump or to reduce the risk of cavitation in the intake conduit, for example at kinks. For this purpose, the pressure p3 upstream of the throttling valves must, as a rule, be raised slightly by means of a pressure source of a known type, for which a height difference between the liquid reservoir and the valve inlet would also be possible. Most hydraulic systems, but particularly hydraulic and fuel-supply systems in vehicles, for these reasons operate in any case with pumps which generate low to very low admission pressures, so that in practice, as a result of this condition, there is no appreciable restriction in the use or incorporation of the invention.

An important discovery on which the invention is based is that, at atmospheric pressure, one liter of fuel or of hydraulic fluid is capable of absorbing approximately 10% by volume of air in dissolved form, and this also goes for a fuel tank of a vehicle. At atmospheric pressure, therefore, a gas volume of approximately 100 cc is contained in one liter of fuel. When the pressure is reduced, this dissolved air escapes in gas form from the solution and, in terms of volume, the gas volume expands to 1000 cc according to the prevailing negative pressure, for example, at 0.1 bar, by ten times. Such gas volumes can very quickly fill the volume present downstream of the valves as far as the displacement spaces and thereby greatly impair the delivery and control of a fuel pump. The same consideration also applies to other liquids. As a result of the restriction according to the invention of $\Delta_{Pömin}$ to no less than 0.9 bar and preferably in the range of between 1.0 and 1.5 bar, the formation of gas volume is kept to a minimum or prevented completely, so that the delivery and control of the pump system do not suffer from this.

The rules in claims 5 and 6 take into account the specific properties of liquids and gases. The formula according to claims 5 and 6 makes it possible, both for pumps with inlet slits and for pumps with automatic spring-loaded inlet valves controlled by the displacer travel, to determine the minimum opening-pressure difference $\Delta_{Pömin}$ at which the or each throttling 2/2-way valve actuated by pressure difference opens. If gas-outlet pressures pgasout and vapor-outlet pressures pvaporout are not known, then 0 bar for these pressures in the formula is on the safe side.

The so-called solubility coefficient describes specifically for a liquid and specifically for a gas the solution behavior according to Henry's equation:

$$cs=k*p$$

wherein cs=saturation concentration of the dissolved gas or gas mixture in the liquid p=pressure at saturation equilibrium (p1)

k=k(T)=solubility coefficient of the gas or gas mixture in the liquid.

In many systems, particularly, for example, in vehicle use, for example on the way from a still cold tank to an already hot engine, a liquid to be conveyed can experience a rapid temperature change.

If the solubility coefficent is lower in the direction of the temperature change, there can occur a sudden supersaturated state of the liquid which can lead to a disturbing gas release as early as upstream of the throttling spring-loaded valve.

In order reliably to prevent this, that is to say at least maintain the saturation concentration, the maximum temperature-related decrease in the solubility coefficient k occurring during operation can be precluded by increasing the minimum opening difference by an amount Δptemp.

If $cs_x=cs_1$, then, with Henry, the following is true $k(T_x)p_x=k(T_1)p_1$ and $p_x/p_1=K(T_1)/K(T_x)$ or $\Delta_{ptemp}=p_x-p_1=(p_x/p_1-1)p_1=(k(T_1)/k(T_x)-1)p_1$ when $k(T_x)<k(T_1)$ in which $T_x$ and $T_1$ define the maximum temperature difference of the liquid occurring during operation at a time interval of a few hours between the liquid reservoir and the throttling spring-loaded valve.

The main advantage of the control device selected according to the invention is the desired rapid, reproducible, low-hysteresis and low-idle time reaction of the conveyed quantity to adjustments of the correcting members. This exact calculable assignment of the collecting-member position and pump throughflow is, again, a precondition for the incorporation of this pump into control loops of hydraulic systems, particularly into those with stringent requirements demanded of the control dynamics, such as there are inter alia also for common-rail diesel injection systems. In view of a theoretically infinitely rapid setting operation of the actuator, the associated full response of the conveyed quantity already occurs with the first subsequent complete suction operation (it cannot, in principle, take place any more rapidly at all). In the hydraulic system, therefore, with knowledge of an expected sudden change in consumption, the conveyed flow of the pump can already also be varied simultaneously.

The pronounced lack of cavities as far as the throttling valve near the displacement space (and, in the special case, when the latter is designed as an inlet valve, as far as the limit of the displacement space) allows the use of various adjusting devices for filling control and many advantageous specializations, since degrees of freedom are obtained in the most diverse pumps of the displacement type.

Particularly preferred embodiments of the control device according to the invention for a filling-ratio adjusting pump can be taken from the further subclaims.

BRIEF DESCRIPTION OF THE DRAWING

The invention is explained in more detail below by means of exemplary embodiments with reference to the drawing in which.

BEST MODES FOR CARRYING OUT THE INVENTION

Figure 1:
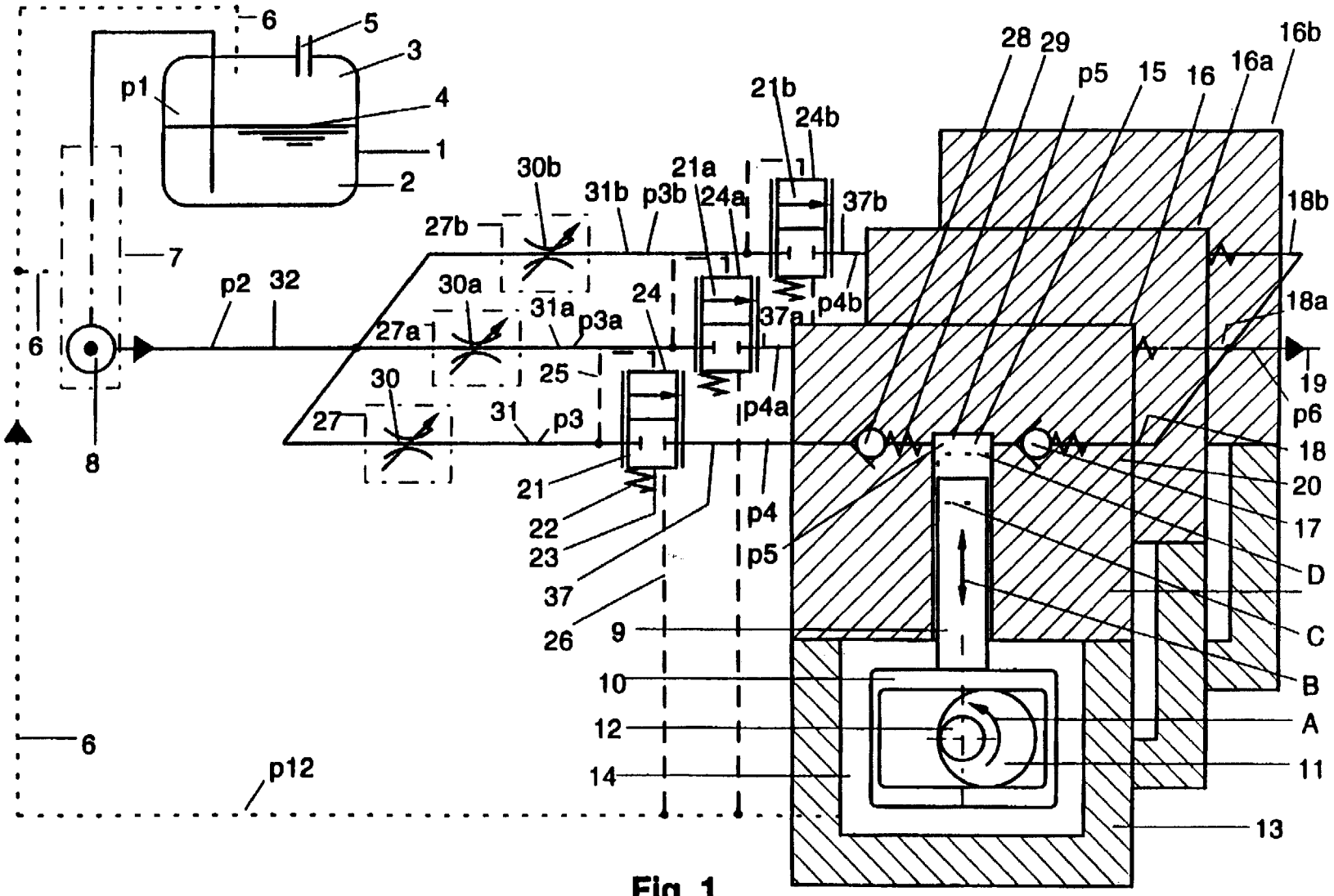
FIG. 1 shows a version according to the invention of a control device for a pump having automatic inlet valves.

FIG. 1 shows a first possible version of a control device for a pump having automatically working inlet valves.

The pump according to the diagrammatic representation of FIG. 1 has three individual displacement pistons 9, only one of which can be seen in FIG. 1. The three displacers are driven by a rotary shaft 12 via respective eccentrics 11, each eccentric 11 being arranged in a lifting member 10 which is located at the lower end of the associated piston 9.

In this case, the rotational movement A of the eccentric 11 initiates an oscillating movement B, the piston 9 moving as a displacer in the displacement space 15 to and fro between the two dead-center positions C (bottom dead center) and D (top dead center) and triggering the periodic suction movement. As a result of the lifting member 10, the piston does not lift off in any phase of its movement from the eccentric 11 (positive displacement movement). An inlet valve 28 and an outlet valve 17 are provided in a way known per se for each displacement space, and both the inlet valve 28 and the outlet valve 17 can be pressurized in each case into the closed positions by respective springs (for example, 29 for the inlet valve 28). This means that the valve 28 is designed as an inlet non-return valve. As a result of the movement of the displacer 9, by virtue of the rotational movement of the eccentric 11 the inlet non-return valve is opened in a known way via the pressure difference p4–p5 occurring and the suction operation is triggered. During the upwardly directed stroke of the displacer 9, the liquid quantity hitherto collected is displaced out of the displacement space 15 through the outlet valve 17, that is to say the latter lifts off from its seat counter to the effect of the pressurizing spring and the liquid, which is now under high pressure, is conveyed via the conduit 18, together with corresponding liquid quantities via the conduits 18*a* and 18*b*, into a common conduit 19, where a pressure p6 prevails and which constitutes, for example, the so-called "common rail" (the distributor pipe) of a "common-rail" injection system.

As is customary in such multi-piston arrangements, the individual pistons or displacers 9 are moved with a phase shift, in order to achieve an equalization of the outlet pressure p6 into the common conduit and in order to ensure that the pump operates with as little vibration as possible. That is to say, if there are three displacers, as shown in the example according to FIG. 1, the individual displacement pistons execute their lifting movement in each case with a phase shift of 120° relative to the adjacent displacer.

The throughflow quantity through each displacer is determined by a respective throttling spring-loaded 2/2-way valve 21 located upstream of this and by an adjusting device 27 which, in this example, is designed as an adjusting throttle 30.

The adjusting device 27, like the identically designed adjusting device 27*a* and 27*b*, is fed from a common conduit 32 which supplies the liquid to be conveyed, here diesel oil, at a pressure p2. The diesel fuel 2 comes from a liquid reservoir 1, where it is in contact with a gas 3 at a pressure $p_1$, here air at atmospheric pressure 1, at a contact face 4. The liquid can be saturated with gas. The liquid first flows through a system 7, in which preferably no further gas is to be introduced into the liquid. Since the pressure is to be increased from p1 to p2, a pressure-increasing device, that is to say a pressure source 8 in this example, is integrated into the system 7.

The diesel liquid in the conduit 32 then flows through the three adjusting throttles 30, 30*a*, 30*b* and the throttling 2/2-way valves 21, 21*a* and 21*b* assigned to these and actuated by pressure difference. By virtue of the continuity equation for incompressible media (which can be assumed only on the basis of the absence of cavities), the throughflow quantity through each adjusting throttle and through the 2/2-way valve 21, 21*a* and 21*b* assigned to it is identical. From this is established a state of equilibrium arising from the pressure p3 at the effective face 24 of the 2/2-way valve 21 on one side and a reservoir-like pressure p12, close to p1, of the effective face 23 on the other side of the 2/2-way valve and from the force of the spring 22 dependent on the opening travel. The adjusting throttles 30, 30*a*, 30*b* can theoretically be adjusted individually for being coordinated with one another.

FIG. 1 discloses a further important advantage of the invention. The system possesses, with the valve effective faces 24, 24*a*, 24*b* and the associated throttles 30, 30*a*, 30*b*, an inherent damping effect which increases with sharper throttling and which is important for the maintenance and reproducibility of the conveying characteristics (see FIGS. 10 and 11). Damping functions in that, even when there is only a slight overshooting of the throttling 2/2-way valves 21, 21*a*, 21*b* in the suddenly commencing opening phase, the increase in volume generated by the product of the face 24, 24*a*, 24*b* and the stroke difference in the connection 31, 31*a*, 31*b* causes a lowering of the pressure $p_3$ by considerable amount $\Delta p_3$ which counteracts the overshooting, this being on account of the lack of cavities according to the invention!

The lower the throttle is set, the longer the time until medium can flow on and the more sustained is the damping effect.

In this exemplary embodiment, the throttling 2/2-way valves 21, 21*a* and 21*b* actuated by pressure difference are each connected at their effective face 23 to the return 6, with the result that the reservoir-like pressure p12, close to p1, prevails at the effective face 23.

The advantage of this arrangement is that, depending on the size of the face 23, the spring 22 can be selected so as to be very weak and serves less for pressurizing than, instead, for the regulating resetting of the valve (21) counter to the opening pressure p3 on the other effective face 24, since, with the pressure p12 at the effective face 23, there is already a considerable part of the necessary pressurizing and perhaps even more.

Figure 2:
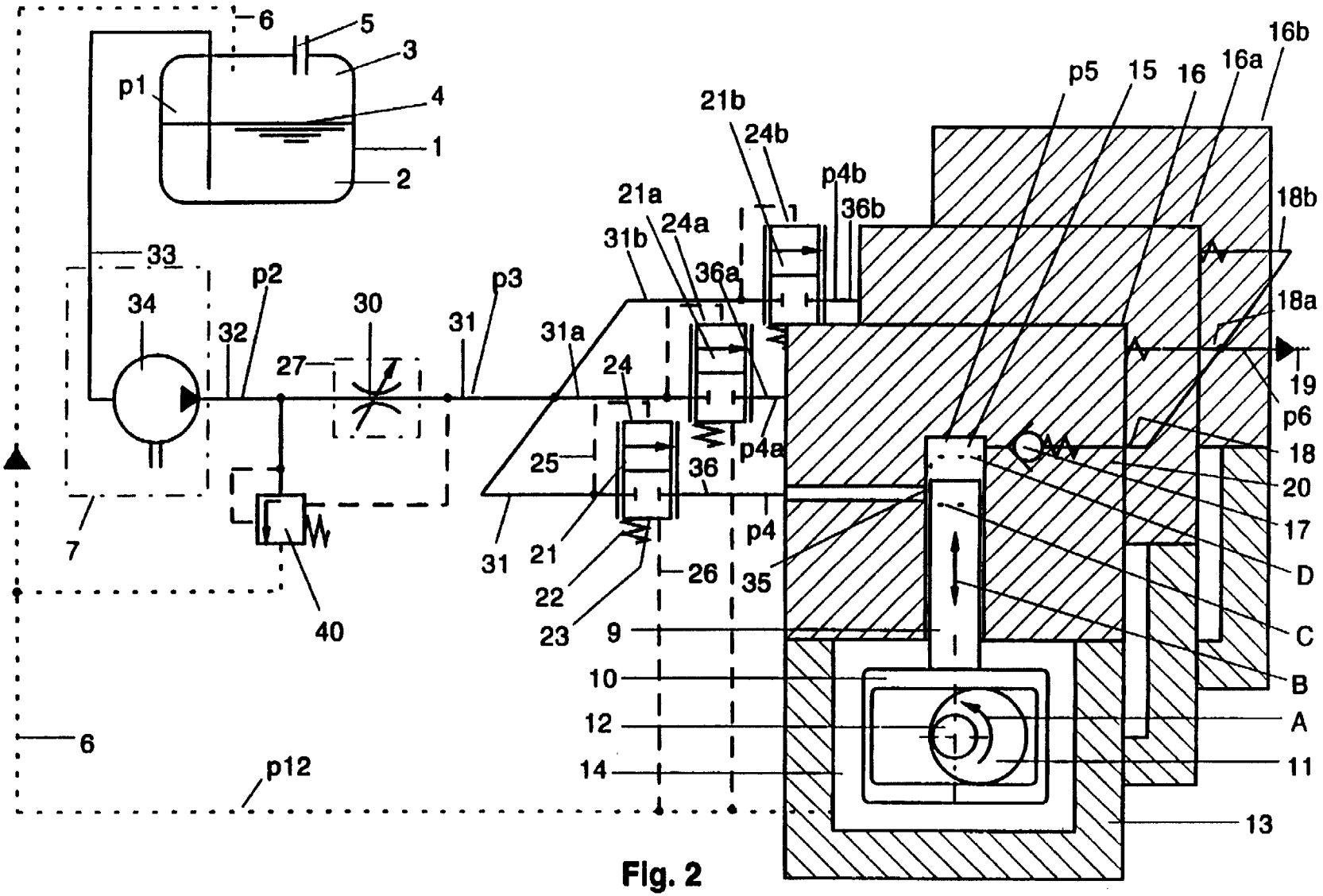
FIG. 2 shows a further version of a control device according to the invention for a pump having inlet slits controlled by the displacer.

FIG. 2 illustrates a similar control device to that of FIG. 1, with the difference that the pump has inlet slits 35 and only one central adjusting device 27 possessing an adjusting throttle 30 is provided. Pumps with inlet slits can as a rule be produced more cost-effectively in contrast to those with inlet valves, whereas they are used to a lesser extent at very high pressures and with low-viscosity pressure media.

In this exemplary embodiment, the aim of low cost is achieved by the central adjusting device 27 which basically allows simple manual adjustment or electrical adjustment. The individual adjusting throttle 30 in the adjusting device 27 can likewise be produced cost-effectively in a way known per se. In the suction phases, the pressure difference p2–p3 across the adjusting throttle is kept approximately constant, irrespective of the throughflow quantity, by means of a pressure-differential valve 40 connected in parallel, with the result that the combination of the adjusting throttle 30 and the pressure-difference valve 40 gives the effect of a flow-regulating valve. The simple act of using the same adjusting throttle 30 for all the displacement elements 16, 16*a*, 16*b* affords further advantages in this configuration having the inlet-side slit control of the pump.

A first advantage is that, for a specific rotational speed and a specific relative filling of the displacement spaces, in terms of the number of displacement spaces served, and the shortness of the respective suction phases, the control cross section of the throttle 30 is substantially larger than, for example, in the individual throttles in the configuration according to FIG. 1. (The same rotational speed and the same relative filling are assumed.

This has a favorable effect on the price and on the production tolerances. Moreover, special contouring of the control cross section over the throttle opening travel is more easily possible, as is an application of the control principle to extremely small pumps.

A second advantage is that, because the short suction phases and uniform phase shift of the displacement movement (=displacement control by the rotary shaft with eccentrics), an overlap of the suction phases is relatively slight or even absent. (An overlap of the suction phases is even absent if the height of the orifice 35 is kept so small that the region covered, that is to say the angular range of the eccentric 11 or of the rotary shaft 12, during the opening of the orifice 35 by the piston 9 is a maximum of 360°/number of displacement elements.

This is equivalent to a locking of one and the same throttle on to the various displacement elements in succession. This signifies the equality of the throttle cross section for each displacement element as an ideal precondition for equal filling or equal conveyance of all the displacement elements.

A third advantage is obtained when the opening angle described is somewhat smaller than the 360° number of displacement elements. More or less short intermediate phases, in which none of the displacement spaces sucks, are then obtained.

The filling of the channel portions 36, 36*a*, 36*b* between the respective 2/2-way valve 21, 21*a*, 21*b* and the respective inlet cross sections 35 (35*a*, 35*b* concealed, cannot be seen in the drawing) can basically continue between the suction phases. This also helps to achieve at least a lack of cavities in the channel portions 36, 36*a*, 36*b*, that is to say as far as the displacement-space limit in the form of the inlet cross section 35.

In the intermediate phases, the pressure $p_3$ in the connecting channels can rise even to a maximum of $p_2$, since no displacement element extracts fluid from the channel portions 36, 36*a*, 36*b* by means of a suction operation. This leads to a temporarily larger opening of the 2/2-way valves and to an acceleration in the filling-up of the channel portions.

Figure 3:
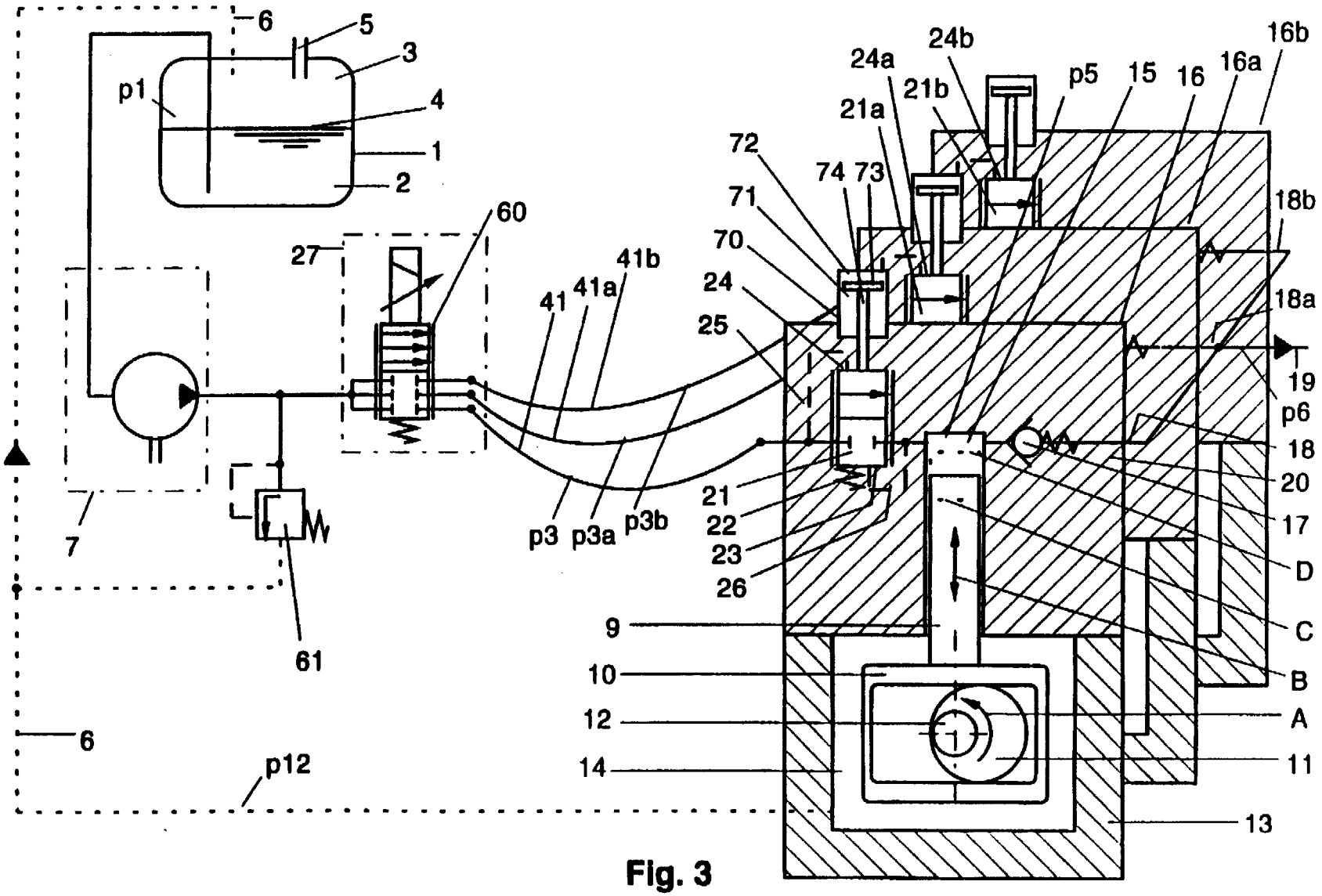
FIG. 3 shows a special design of a control device according to the invention for a pump, the inlet valves being designed with a special spring characteristic and with a damper, and the adjusting throttles being combined in a continuous direction valve.

FIG. 3 illustrates a particularly favorable embodiment of the control device of FIG. 1.

This shows the possibility, achieved as a result of the absence of cavities, of arranging the adjusting device for the throttling 2/2-way valves 21, here integrated in the pump, at a greater distance from these or the individual displacement spaces. This makes it possible to combine a plurality of or all the actuating elements into one actuator 60 in the form of a continuous directional valve with only one drive, which then again makes, for example, simple manual actuation possible. In the event of an electrical pump adjustment, the need for only one transducer for a plurality of or all displacement spaces is a great advantage in terms of cost and of constructional space.

Simply combining the individual throttles belonging to the displacement elements into the continuous directional valve 60 also allows an optimum equal control of the individual throttles. As is known, the control orifices of control slides and housings of such valves are usually produced in a fixture, which means a low-fault immovable positioning of these orifices relative to one another.

An important property of the invention is the liquid volumes enclosed between the one adjusting device 27 and the individual throttling 2/2-way valves 21 in a channel are scarcely elastic on account of the absence of cavities, so that also scarcely any additional liquid quantities have to flow in or flow out in order to achieve the particular stationary states of a filling operation or of the time period located between two filling operations. Consequently, the geometrical channel volumes are permitted to deviate sharply from one another, which is why the invention is suitable for all geometrical displacer arrangements (for example, axial, radial, in-line in the case of piston pumps). A location for the adjusting device 27 which is favorable in terms of the constructional space and of the appearance can be found for all these displacer arrangements.

In this example, the adjusting device 27 is even linked to the pump by means of hose conduits 41, 41*a*, 41*b*, thus allowing a possibility for the remote control of the pump over a length which is a multiple of the characteristic pump dimension (for example, the diameter in the case of a radial piston pump).

FIG. 3 also shows a further possible and advantageous version of the invention, in so far as an additional damper supplements the inherent damping described further above under FIG. 1. The damper shown is only one example of possible designs. In this example, the respective throttling 2/2-way valves 21 actuated by pressure difference are connected to respective damping pistons 73 which are movable to and fro in respective cylinders 70 according to the movement of the slides of the 2/2-way valves 21. In view of the lack of cavities, the effect of the damping is good and constant. At the same time, damping chambers 71 and 72 are formed in the respective cylinder 70 on opposite sides of the respective damping pistons 73. During the displacement of the damping pistons 73 according to the opening or closing of the respective slide of the associated 2/2-way valve 21, liquid flows past the piston from the chamber 71 into the chamber 72 or from the chamber 72 into the chamber 71 and through the guide gap of the rod 74 and damps the movement of the piston and therefore of the corresponding slide of the 2/2-way valve 21. This contributes to avoiding an uncontrolled overshooting of the valve movement, since this would have an influence on the conveyed-flow characteristics.

FIG. 3 also shows a favorable version of the invention, in so far as the 2/2-way valves 21 actuated by pressure difference are designed at the same time as inlet valves, thereby making a saving in outlay.

Figure 4:
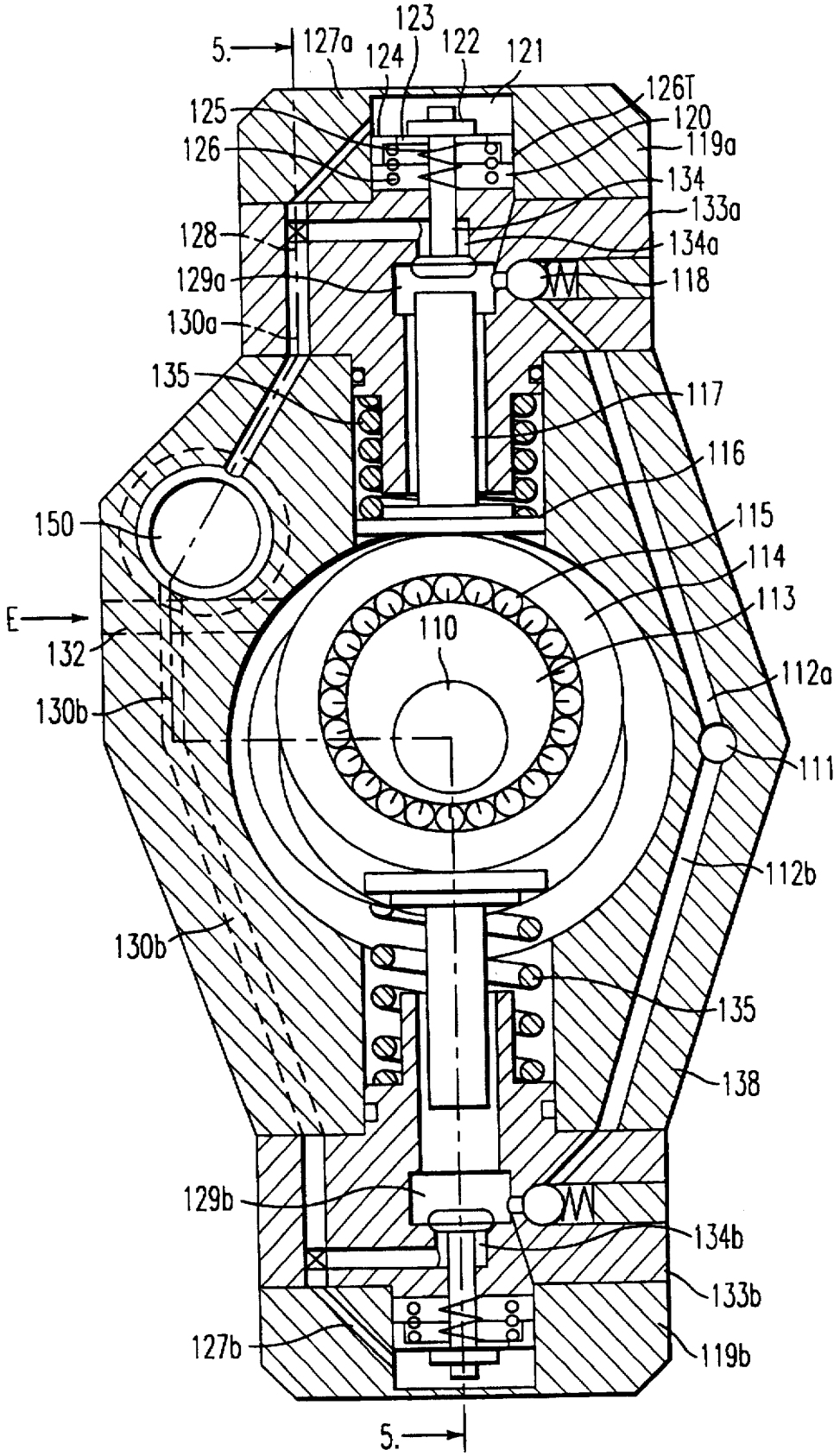
FIG. 4 shows a cross section through a finished pump, with a control device according to the invention which is installed in the pump.
Figure 5:
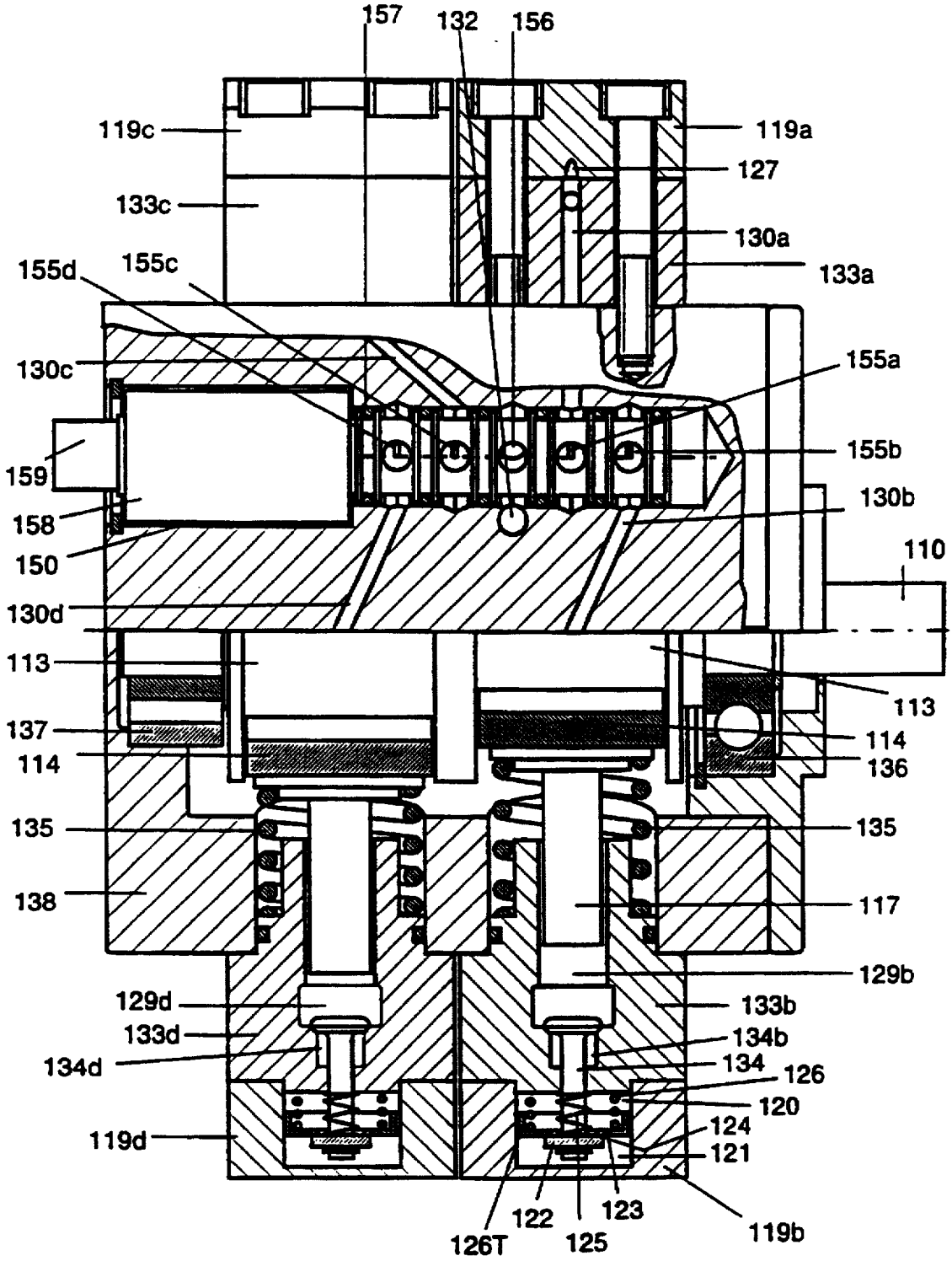
FIG. 5 shows a diagrammatic view of the pump with control device of FIG. 4, partially in longitudinal section along the line V—V in FIG. 4, FIGS. 6A and 6B show drawings to explain the mode of operation of the inlet valves of the pump of FIGS. 4 and 5, FIG. 6A representing the opening operation and FIG. 6B the closing operation.

FIGS. 4 and 5 show, in cross-section and in longitudinal section respectively, a particularly favorable design of a pump with a control device according to the invention. The pump according to FIGS. 4 and 5 is equipped with four displacement spaces 129*a–d* which are arranged in pairs above and below the drive shaft 110. The displacement space 129*b* cannot be seen in the drawing, since, in FIG. 5, it is located behind the sectional plane (V—V in FIG. 4) in the upper part of the drawing.

A respective piston or displacer 117 is provided for each displacement space. The displacers 117 are kept in contact by means of respective springs 135 with two drive rings 114 mounted eccentrically on the drive shaft 110. The drive rings 114 are mounted rotatably by means of needle bearings 115 on eccentrics 113 which are connected fixedly in terms of rotation to the drive shaft 110 in a manner offset relative to one another.

The springs 135 for the respective displacement pistons 117 are supported on a plate-like abutment 116 at the end of each individual displacement piston, and the drive ring 114 presses on to the respective sides of the spring abutments 116 located opposite the displacement pistons 117. The rotation of the drive shaft 110 therefore causes, via the eccentrics 113 connected fixedly in terms of rotation to it and via the rings 114, a to-and-fro movement of the displacement pistons 117, the stroke movement of the upper displacement pistons 117 taking place in a manner offset at 180° to the stroke movement of the respective opposite lower displacement pistons 117. This means, for example, that the displacement space 129*a* has its smallest volume while the displacement space 129*b* has its largest volume, and vice versa. Two eccentrics 113 are connected to the rotary shaft 110 in a manner offset at 90° relative to one another, so that the stroke-phase difference of two displacement pistons 117 arranged next to one another, that is to say of the lower displacement pistons 117 in FIG. 5 and the upper displacement pistons, likewise amounts to 90°. This contributes, on the one hand, to a quiet running of the pump and, on the other hand, to a uniform delivery of liquid.

The rotary shaft 110 is mounted rotatably in the main housing 138 of the pump via the ballbearing 136 and the roller bearing 137.

The respective inlet valve 134 and the respective outlet valve 118 are provided for each displacement space 129*a–d* (of which the displacement space 129*c* is not shown). The respective pairs of inlet and outlet valves 134, 118 belonging to respective displacement spaces 129*a–d* are accommodated in respective housing parts 133*a–*133*d*, in which the cylinders forming the displacement spaces 129*a–d* and serving for receiving the displacement pistons 117 are also arranged. These housing parts 133*a–d* each have a cylindrical extension which is arranged coaxially to the respective cylinder, that is to say to the respective displacement piston 117, and which is inserted in a corresponding cylinder bore of the main housing part 138. A respective annular gasket is located between the cylindrical extension of each housing part 133*a–d* and the housing 138, so that the main housing 138 is sealed off against leakage. Moreover, the cylindrical extension of each housing part 133*a–d* has an annular shoulder, on which the end of the respective spring 135 facing away from the plate-like abutment 116 is supported. That is to say, the annular shoulder forms a further abutment for the spring 135.

Figure 6A:
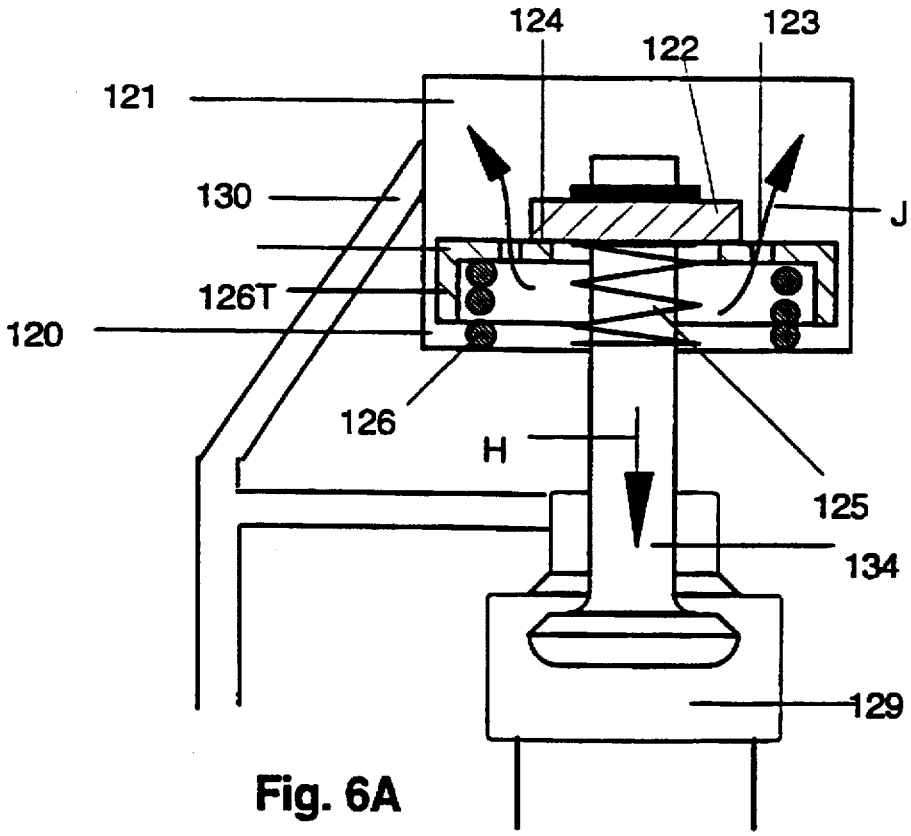
Figure 6B:
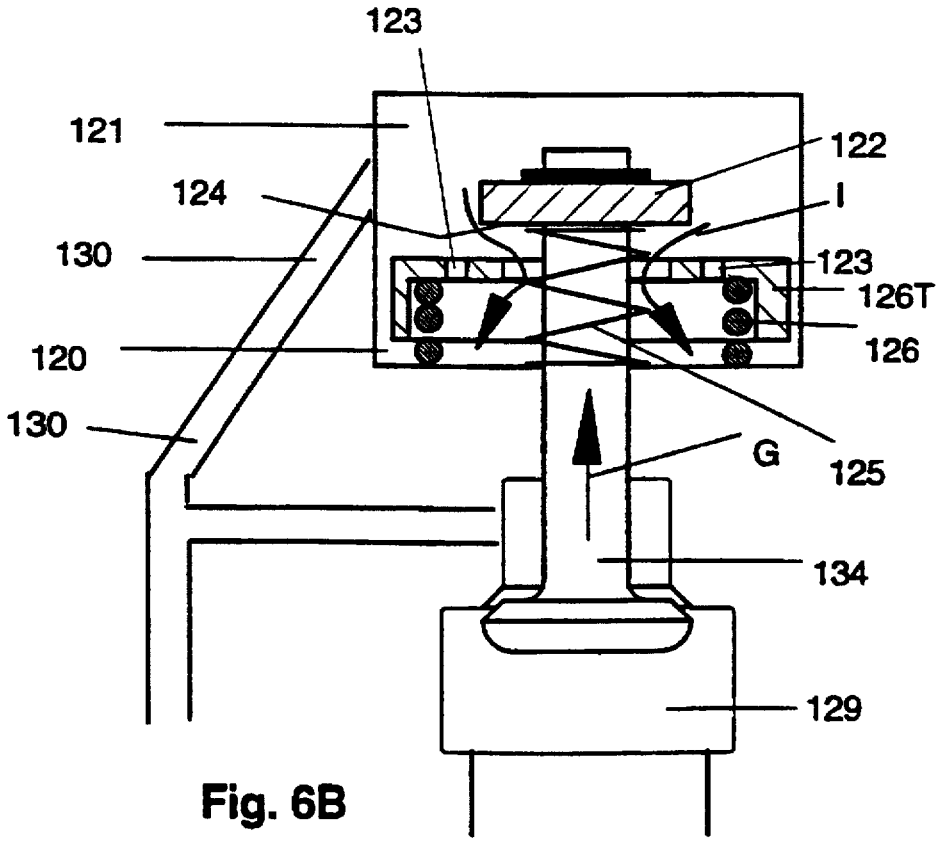

Each housing part 133*a–*133*d* is also provided with a respective valve cover 119*a–d*, the individual valve covers 119*a–d* each having a cylindrical recess 121 which is arranged coaxially to the cylindrical extension of the respectively assigned housing part 133*a–d* and which receives a shank part of the inlet valve 134 and the components which cooperate with this and which are shown on an enlarged scale in FIGS. 6A and 6B. The valve covers 119*a–d* and the housing parts 133*a–d* are screwed to the crankcase 138 by means of continuous screws which are shown in FIG. 5.

On the left-hand side of FIG. 4 a hollow rotary slide valve 150 can be seen, which is integrated into the construction and which can be designed, for example, according to German Patent Specification 3,714,691. To this embodiment, the valve 150 constitutes the adjustable element which serves for controlling the throttling 2/2-way valves actuated by pressure difference, which, in this embodiment, are formed by the respective inlet valves 134 together with the associated parts, as described in more detail a little later.

Starting from the rotary slide valve 150, there are provided four distributor bores or distribution paths 130*a–d* (130*c* not shown) which lead to the respective inlet valves 134, specifically, in each case, into a chamber 134*a–d* on the shank side of the valve, immediately adjacent to the respective valve seat, the chamber 134*c* not being shown. Starting from each distribution path 130*a–d*, there are located in the respective cylinder heads 119*a–d* respective oblique bores 127*a–d* which open into the cylindrical spaces 121, the oblique bores 127*c* and 127*d* being shown.

On the inlet side, the hollow rotary slide valve 150, which, in this example, is designed as a plug-in cartridge exchangeable in a simple way, receives liquid in the direction of the arrow E via a housing bore 132 from a reservoir 1 of the pressure p2, as shown, for example in FIG. 3. The fluid passes further, without any significant pressure loss, into the interior of the hollow rotary slide via a constantly opened sufficiently large inlet cross section 156. As a result of the rotation of the hollow rotary slide, which can take place by means of an electrical drive 158 (FIG. 5) or a gas linkage which is not itself shown, but which engages on the part 159, an adjustable throttle effect is achieved by the cooperation of elongate linear control slits 155*a*–155*d* in the hollow rotary slide 150 with the mouth edges of the distributor bores 130*a*–*d* (130*c* not shown), so that the pressures p3 prevailing in the distribution conduits 130*a*–*d* can be set exactly and rapidly by means of the actuating element 159.

In particular, the valve cartridge, on the rearside (not shown), can have in each chamber symmetrically opposed identical orifices 115*a*–115*d* and 156 and the movable slide can be made very thin-walled, so that the valve has the advantages of a valve according to German Patent Specification 3,714,691.

As can be gleaned from German Patent Specification 3,714,691, the advantage of rotary slides or axial slides of this type is that, as a result of low friction, low inertia and low flow forces, they can be actuated very quickly and accurately by means of low actuating forces, so that the electrical actuating drive (actuating-drive motor) 158 can be made small and cost-effective. On the outlet side, as provided in the previous embodiments, there extend away from the respective outlet valves 118 flow-off bores 112*a*–*d*, of which the flow bores 112*c* and *d* are not shown and which merge into a common flow-off conduit 111 which leads, for example, to the "common rail" of a common-rail diesel injection system.

The pressure p3 in the distribution conduits 130*a* to 130*d* is communicated via the oblique bores 127*a*–*d* in the respective cylinder spaces 121 and here acts in the opening direction on the valve 134 via the cross-sectional surface of the shank of the valve 134. In the closed state of the valve 134, the same pressure p3 also acts in the opening direction of the valve on the side of the valve head facing the chamber 134 [sic]. At this stage, the two springs 125 and 126 exert a closing force on the valve 124. The relatively strong spring 125, which engages on the abutment 124 at the end of the valve shank, permanently exerts a closing force on the valve 124, whilst the relatively weak spring 126 is supported on a spring plate 126T which is arranged displaceably opposite the valve 124 in the chamber 121. In the closed state of the valve and when the spring plate 126T bears on the abutment 124, the spring 126 also exerts a closing force on the valve 134. However, the spring plate 126T with spring 126 primarily serves for damping purposes. When the respective displacement space 129*a*–*d* is enlarged as a result of the movement of the respective displacement piston away from the top dead center (TDC), a lower pressure prevails on the displacement-space side of the valve than in the cylindrical space 121, so that, altogether, a force acts on the valve member 134*a* which leads to an opening of this member. At the same time, both the strong spring 125 and the weak spring 126 are compressed. The liquid located underneath the spring plate 126T escapes through the damping orifices in the spring plate 126T and therefore slows the opening of the valve member 134.

The amount of the opening stroke of the valve member 134 and the quantity of liquid flowing past the head of the valve member 134 into the displacement space 129 depend on the pressure p3 in the distribution conduit 130.

During the displacement movement of the displacement piston 117, the volume of the displacement space 129 decreases and the pressure in this space rises, albeit initially only slightly on account of the small quantity of gas or liquid molecules which have escaped. The result of this is, on the one hand, that a closing force which is higher than the opening forces is exerted on the valve member 134, so that the valve 134 closes. By this stage, the damping orifices in the spring plate 126T work in order to damp the closing movement of the spring plate, so that the valve 134 closes against the valve seat relatively gently and the spring plate 126T at a somewhat later time likewise comes to bear gently against the abutment 124. This means that the damper is designed so that it is effective only during the opening stroke of the throttling valve, that is to say in the phase in which vibrations would most easily be introduced and would be effective the longest. According to FIG. 6, in the closing phase, the damping piston can lag behind the valve movement. Fluid flows through the orifice which is becoming exposed into the damper space under the damping piston and prevents negative pressure and cavities from forming. The rising pressure in the displacement spaces 129*a*–*d* also causes the respective outlet valve 118 to lift off, so that diesel passes at the desired initial pressure into the conduits 112*a*–*d* or 111.

This arrangement has various advantages. The valve 150 can be integrated into the pump construction in a space-saving manner, since it is not important to have distribution paths 130*a*–*d* of differing length. The design of the valve 150 with elongate linear slits 155*a*–*d* allows particularly good regulatability of the pump down to the very smallest conveyed quantities.

The use of seat valves 134*a*–*d* as inlet valves, which serve here at the same time as the throttling 2/2-way valves actuated by pressure difference according to the invention, is, as a rule, the version which is more cost-effective than the use of slide valves, and above all the displacement space has one leakage path less, which is particularly important in pumps for very high pressures, low rotational speeds and very low viscosities (such as occur in conjunction with common-rail diesel injection), if very high efficiencies are to be achieved. The tightness of the inlet seat valves 134 also has a positive effect on the equal conveyance from displacement space 129*a*–*d* to displacement space 129*a*–*d*, since leakage is usually closely associated with component tolerance. The general conveying characteristics of the pump, too, can be maintained more effectively in mass production in constructions with a seat valve. Vibrations of the throttling valves, like vibrations in general, can lead to spring fractures or, in the case of seat valves, to increased wear or shank fracture, and here these vibrations are, above all, also harmful with regard to the conveying characteristic which is varied thereby. Vibrations often occur by chance as a result of stochastically fluctuating damping effects or excitations. In such a case, there would arise on the pump stochastic fluctuations in the conveyed quantity or hysteresis effects which would both make it difficult to use the pumps for regulating purposes. For the purpose of specific valve damping, therefore, the use of a damper on the throttling valve is proposed. In the simple piston dampers of known type, the damping forces also generate negative pressures which can in turn generate cavities harmful for the damping function. This can be eliminated by a higher valve pressurization when such a damper is used. If the damping-piston diameter is kept large, for example at the size of a valve diameter, the negative pressures and necessary additional valve pressurization are reduced. This is desirable since the admission pressure of pumps is, as always, to be kept as low as possible.

The possibility of arranging the adjusting elements at a greater distance from the throttling valves or individual displacement spaces makes it possible to combine a plurality of or all the actuating elements into one actuator with only one drive, which in turn then makes, for example, simple manual actuation possible. In the event of electrical pump adjustment, the need for only one transducer for a plurality of or all the displacement spaces is a great advantage in terms of cost and of constructional space. In addition, the liquid volumes enclosed between an adjusting element and a throttling valve in a channel are scarcely elastic on account of the absence of cavities, so that also scarcely any additional liquid quantity has to flow in or out in order to achieve, in each case, the stationary states of a filling operation or of the period of time located between two filling operations. Consequently, the geometrical channel volumes are permitted to deviate sharply from one another, which is why the invention is suitable for all geometrical displacer arrangements (for example, axial, radial, in-line in the case of piston pumps) and a location for the adjusting device 27 which is favorable in terms of the construction space and the appearance can be found for all of these.

Figure 7:
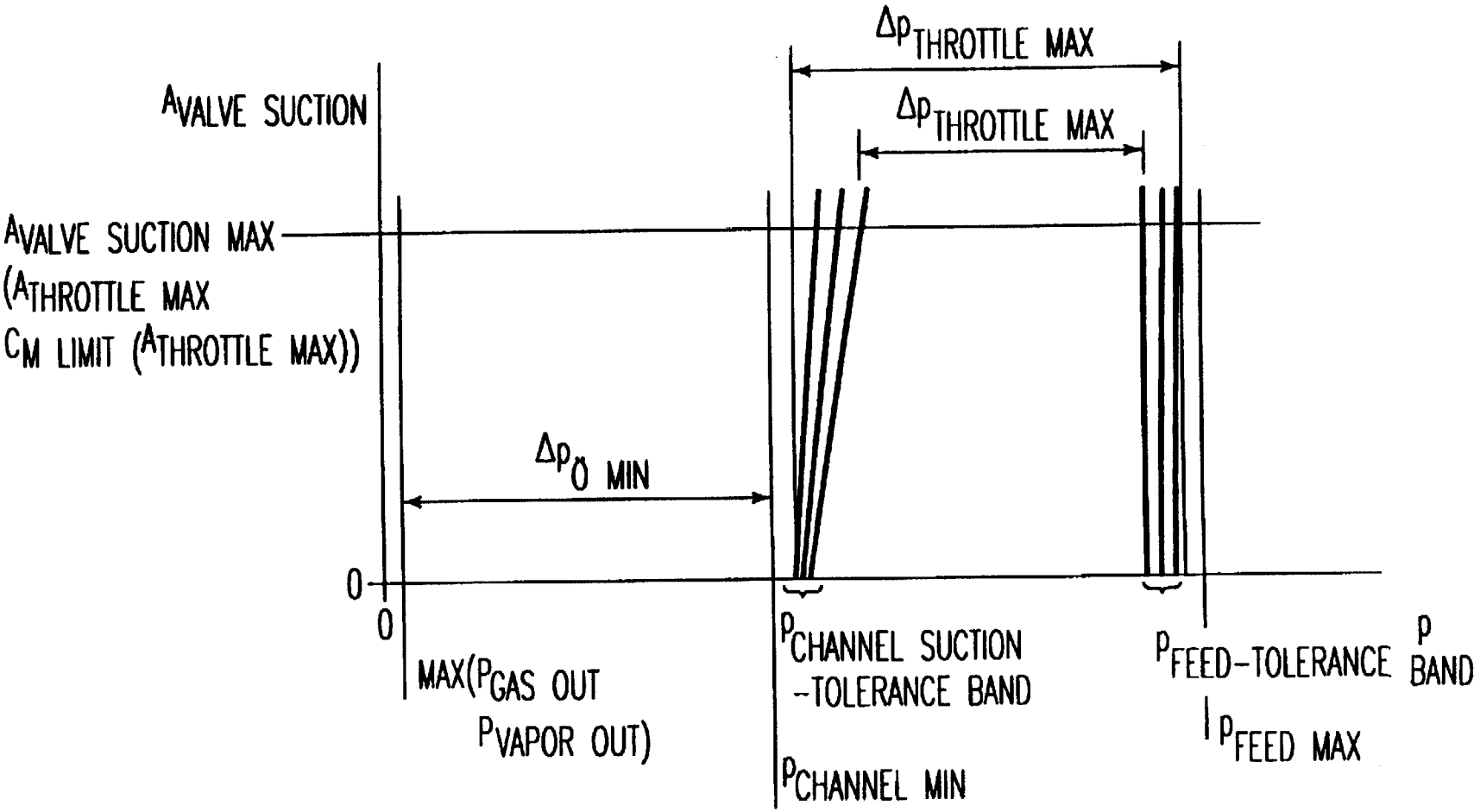
FIG. 7 shows a drawing to explain the design of the characteristic of the throttling valves.

FIG. 7 shows, for throttle-actuating elements, some particular features of the design of the throttling valves, for example of the valves 30 in FIG. 1 or 150 in the version according to FIGS. 4 to 6.

However, for the exemplary embodiments of FIGS. 1, 3, 4 and 5, each with a throttle point for each displacement space, this involves a high outlay.

With the arrangement according to the invention, the pressure difference at the adjusting element influences the metered liquid quantity with the root of the pressure difference. At a fixed feed pressure, however, this pressure difference decreases with increasing throttle-valve opening. The use of a differential-pressure valve 40 in FIG. 2 shows how this pressure difference can be kept basically constant, in that, by the use of the differential-pressure valve, the admission pressure can be co-varied in parallel with the pressure upstream of the throttling valve.

However, the same objective can be at least essentially achieved in that the spring-loaded throttling 2/2-way valves have a steep opening characteristic, this being achieved by means of a soft spring or a large pressure-loaded valve face or a combination of both, and in that the feed pressure p2 is not sufficiently high, so that even for a maximum volumetric flow of the pump, that is to say a large valve opening, the pressure difference is not appreciably reduced via the adjusting device. These measures thus basically ensure that the throughflows at the throttle elements are influenced only slightly by dispersions of the spring rigidity or spring pretension of the inlet-valve springs or by differences in the effective valve face. This design therefore also does away with the need for accurate spring sorting or the setting of the spring pretension on each individual inlet valve.

Figure 8:
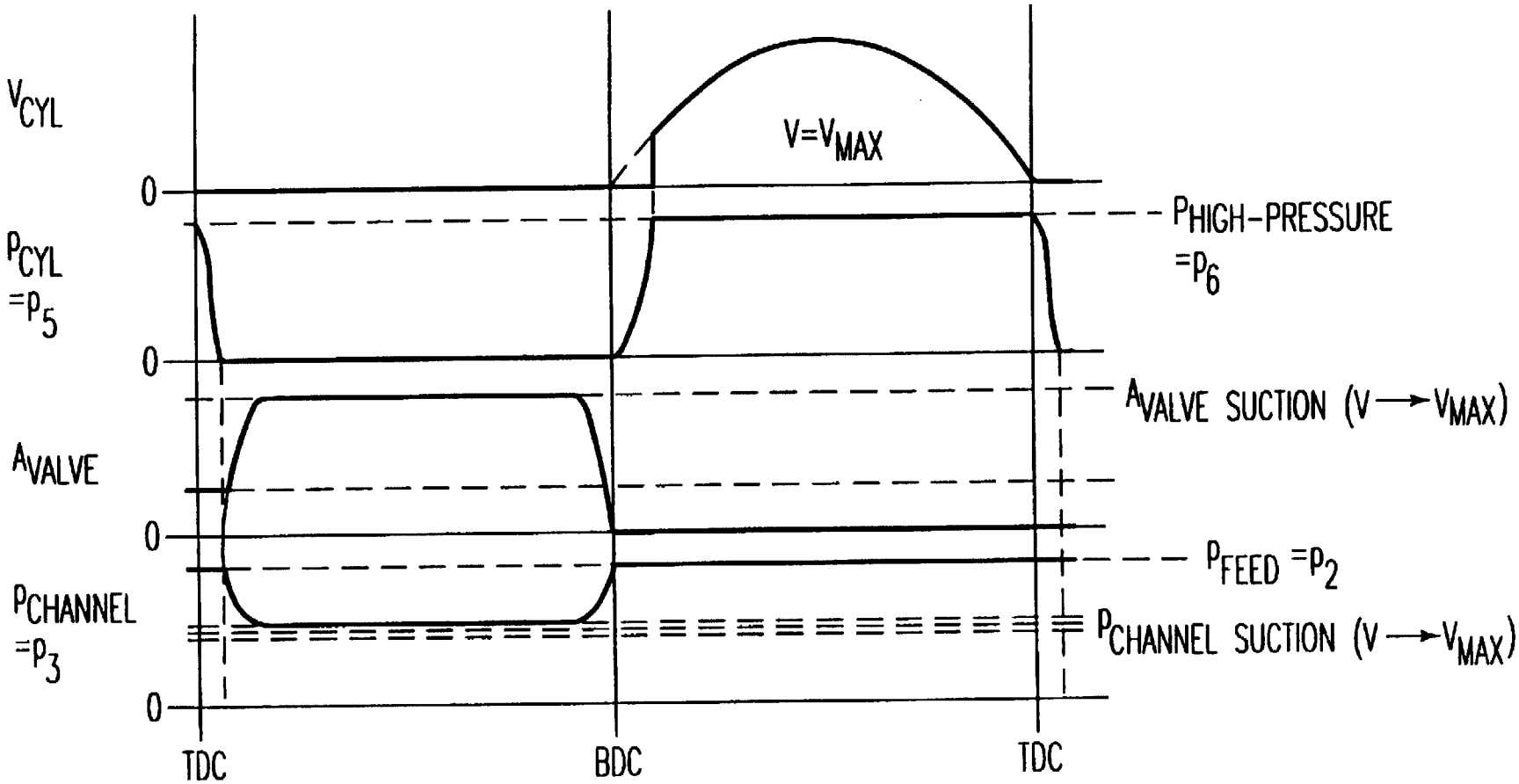
FIG. 8 shows a graphic representation of the work cycle of a pump according to FIG. 3 for full conveyance.
Figure 9:
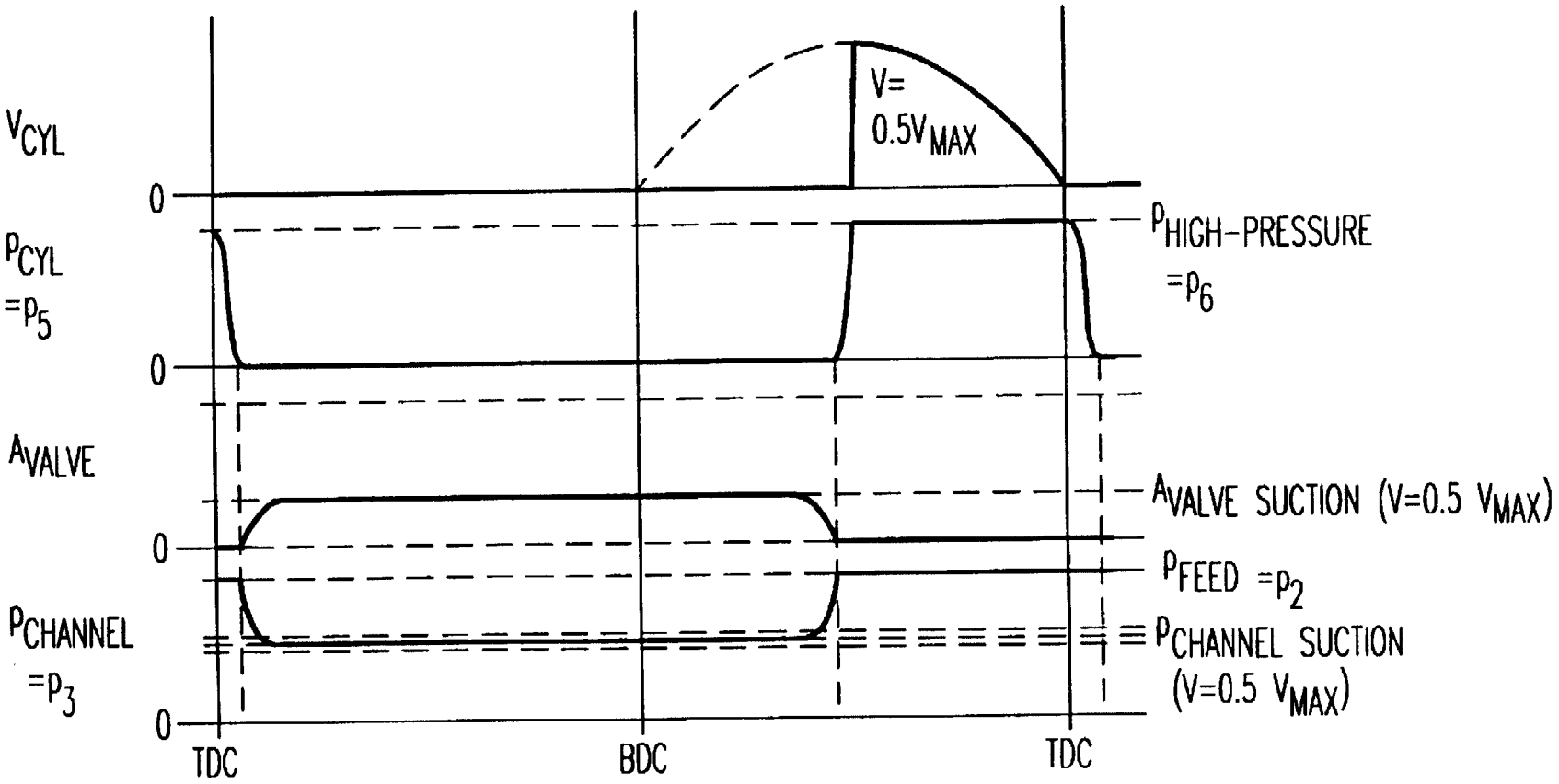
FIGS. 9 and 10 show representations corresponding to that of FIG. 8, but for half conveyance and zero conveyance respectively.
Figure 10:
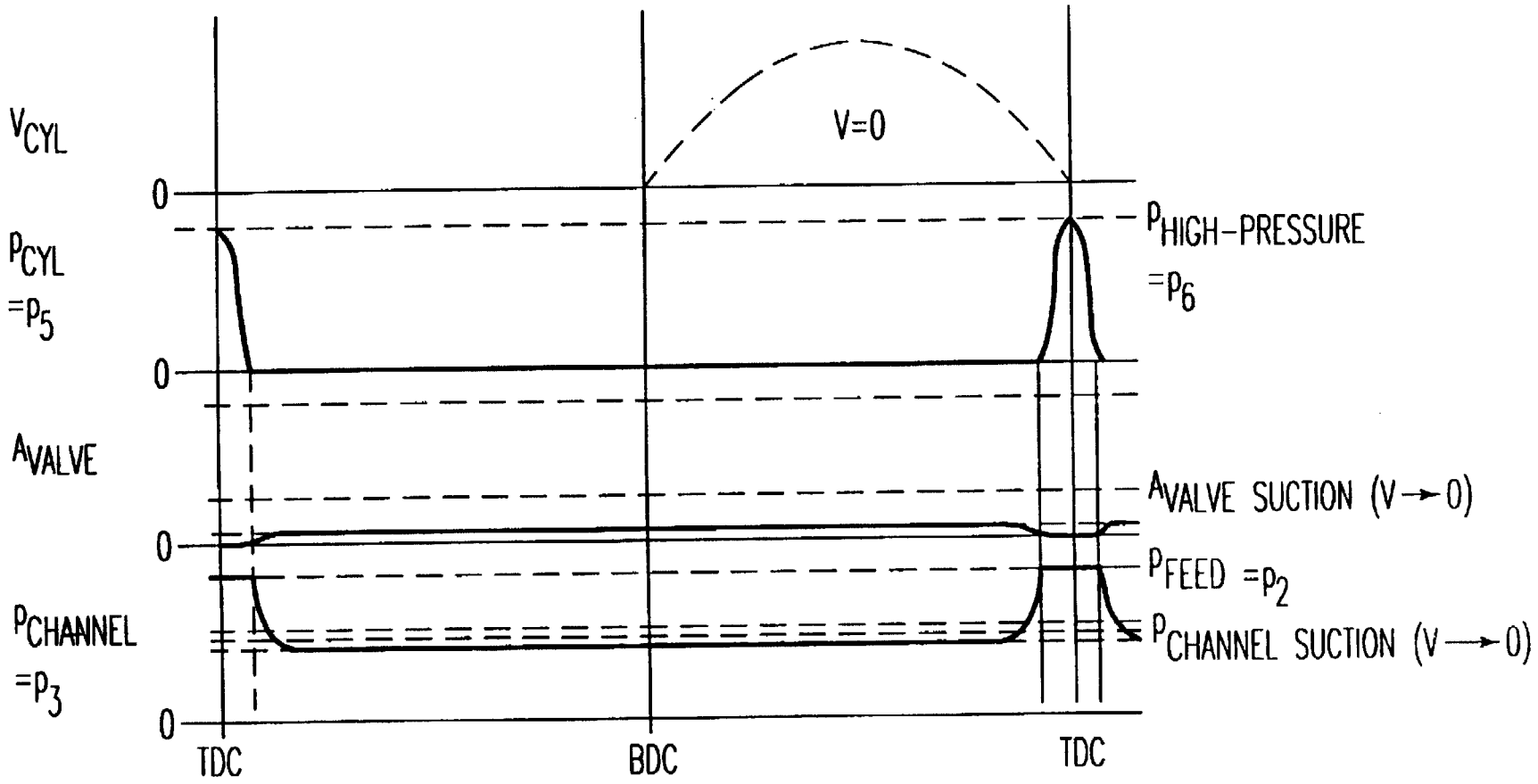

FIGS. 8, 9 and 10 show diagrammatically, for the versions according to FIG. 3 and 4, 5 respectively, different displacement-space fillings at the same rotational speed and how the dynamic process of a work cycle takes place with the spring design, as explained above. FIG. 8 shows the state for the full filling or conveyance of the displacement spaces 15, FIG. 9 the state for the half filling or conveyance of the displacement spaces 15 and FIG. 10 the state of not quite zero conveyance of the displacement spaces 15, specifically as a function of the rotary angle of the drive shaft, in relation to the top dead center TDC and bottom dead center BDC of the respective displacement pistons 9. In FIGS. 8 and 9, the valve cross-section trends $A_{valve}$ and the pressure p5 in the cylinder during the suction stroke are almost rectangular for full displacement-space filling $V=V_{max}$ and for half displacement-space filling $V=0.5\ V_{max}$, and, despite the dynamics, the pressure differences $P_{feed}-P_{channel\ suction}=p2-p3$ during filling are stable and almost equal for all conveyed quantities.

The reason why the stroke of the throttling 2/2-way valve 21 and the pressure $p_4$ can be established virtually immediately and in a stable manner is the cavitation avoided, according to the invention, in the channels 31*a, b, c* or 31 *a, b, c* or 130*a, b, c, d* or adjusting element 27 or 150.

As already stated further above, for the pressure $p_5$ in the displacement space 15, in each case a constantly low value, in the example close to zero, is established beyond BDC up to the valve closing.

In this way, during the entire suction operation (valve opening to closing), virtually constant boundary conditions in the form of virtually constant values of the feed pressure $p_2$ and of the displacement-space pressure $p_5$ prevail.

In view of the absence or lack of cavities achieved according to the invention in the connections 41*a, b, c* or 130*a, b, c, d*, incompressibility may be assumed between the inflow at pressure $p_2$ and displacement space $p_5$. Consequently, the pressure $p_3$ upstream of the throttling valve 21 is established without appreciable delay as a result of the continuity condition that the throughflow at the individual throttle cross section 30, $\dot{V}_{30}$, must be equal to the throughflow of the throttling valve 21, $\dot{V}_{21}$:

$$\underbrace{\alpha_{30}\cdot A_{30}\sqrt{\frac{2(p_2-p_3)}{p}}}_{\dot{V}_{30}} = \underbrace{\underbrace{\alpha_{21}(C_1p_3-C_2)}_{A_{21}(P_3)}\sqrt{\frac{2(p_3-p_5)}{p}}}_{\dot{V}_{21}}$$

with $\alpha_{21}$, $\alpha_{30}$ $c_1$, $c_2$ constants which define $A_{21}$ $(p_3)$, and p is the liquid density.

In the suction phase, therefore, a specific $A_{21}$ $(p_3)$ and, via the constants $c_1$ and $c_2$, also a specific $p_3$ are fixedly assigned to a specific $A_{30}$.

Compliance with the fixed assignment, for example as safety against the overshooting of the valve 21 during opening, is ensured by the inherent damping, already described further above, of the arrangement according to the invention and the additional damping 70 or the valve damping described in FIG. 6A.

The pressures $p_3$ for the various filling situations are close to one another in comparison with $p_2$ and $p_5$ as a result of the special valve design (see FIG. 7). The above equation is thereby simplified to $$A_{21}=\frac{\alpha_{30}}{\alpha_{21}}A_{30}$$

In the complete filling of the displacement space 15 according to FIG. 8, the free flow cross section $A_{valve}$ through the inlet valves 28 assumes the maximum value. In the half filling of the displacement space 15 according to FIG. 9, the valves 28 are only partially opened. The conveyed volumes V correspond to the areas under the volumetric-flow functions. FIG. 10 shows the situation in which conveyance is exactly 0 and filling therefore likewise goes towards 0. In FIG. 10, as a limit situation, the liquid is still at $p_5=p_6$ at top dead center, that is to say is compressed to the high pressure of the system and decompressed again, but nothing is expelled in the meantime. Despite 0 conveyance, a slight filling of the displacers can occur, in order to cover any piston leakage as a result of compression/decompression. A minimal opening $A_{suction}$ ($V\rightarrow 0$) is therefore marked in FIG. 10. The duration of this opening extends approximately over the entire revolution, interrupted only by the relatively short compression/decompression phase. Similar trends occur for the further embodiments according to FIGS. 2, 3 and 4 to 6 as well as 13, 14, 15, 16 and 17.

Figure 11:
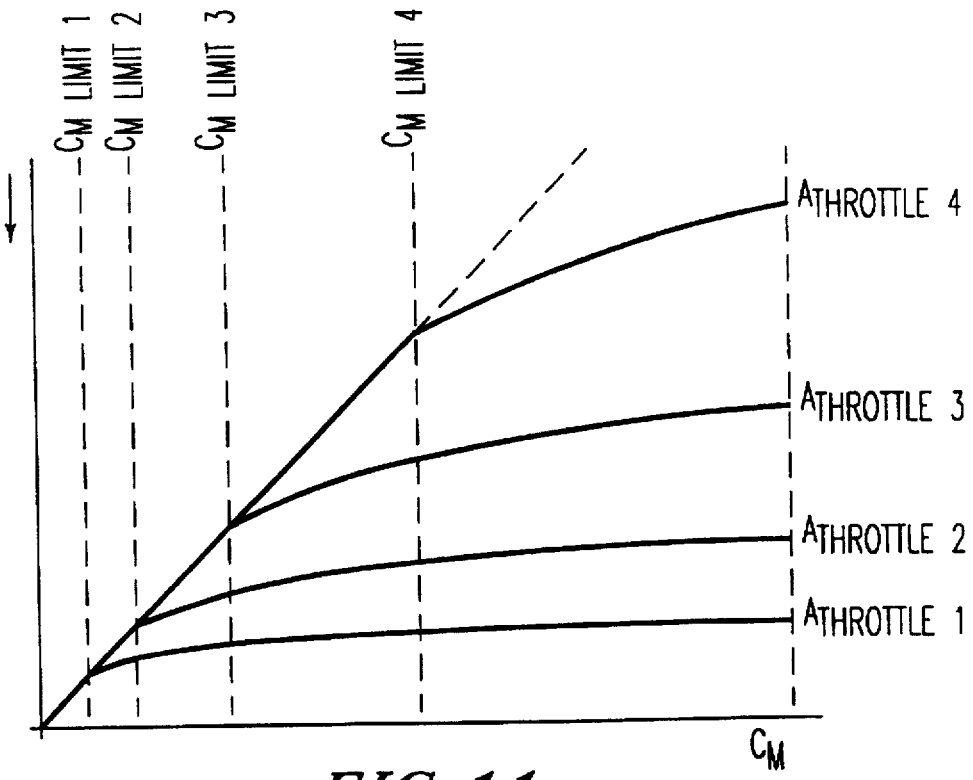
FIG. 11 shows conveyed-flow characteristics of a pump according to FIG. 3.

FIG. 11 shows the conveyed-flow characteristics volumetric flow $\dot{V}=dV/dt$ as a function of the throttle cross section $A_{throttle1}$ to $A_{throttle4}$ of the adjusting throttle 30 of this control device. The characteristics increase asymptotically from the respective limiting rotational speed $C_{m\ limit1}$ to $C_{m\ limit4}$ towards a volumetric flow double the limiting rotational speed, since, in addition to the suction cross section, the suction time is also influential and, as is also evident from FIGS. 8, 9 and 10, this increases, with a conveyed quantity per stroke towards zero, from a half revolution originally to almost one complete revolution, that is to say double.

Figure 12:
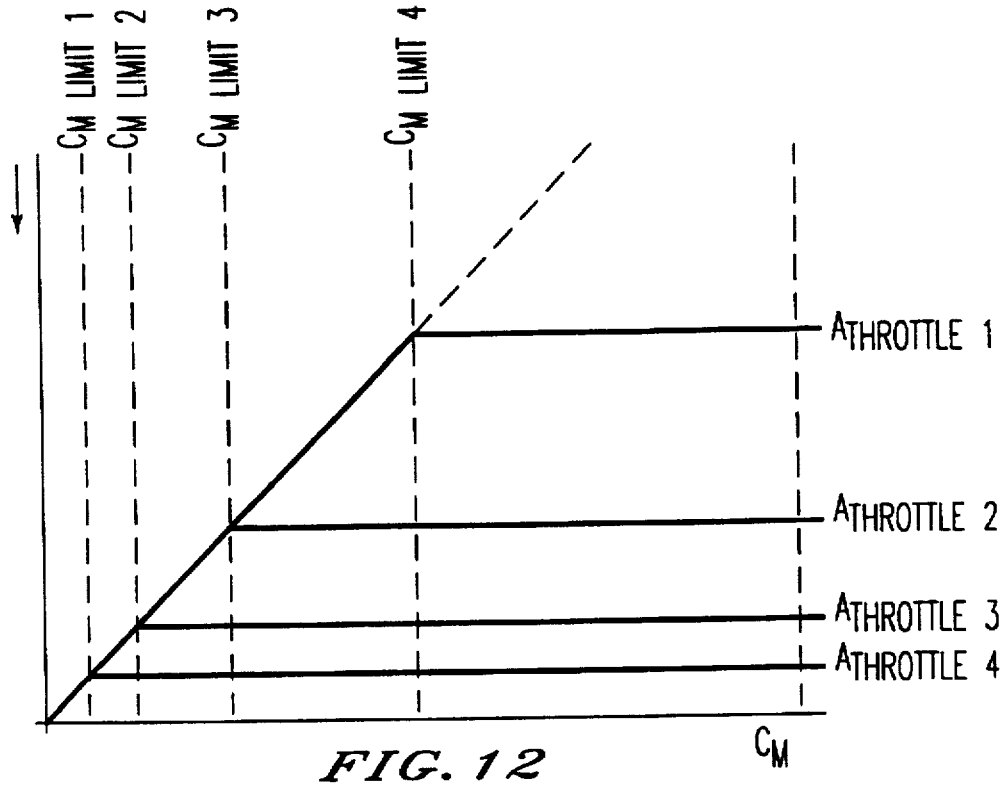
FIG. 12 shows conveyed-flow characteristics similar to those of FIG. 11, but for a slit-controlled pump.

FIG. 12 shows the corresponding conveyed-flow characteristics for slit-controlled pumps, as in the version according to FIG. 2.

Figure 13:
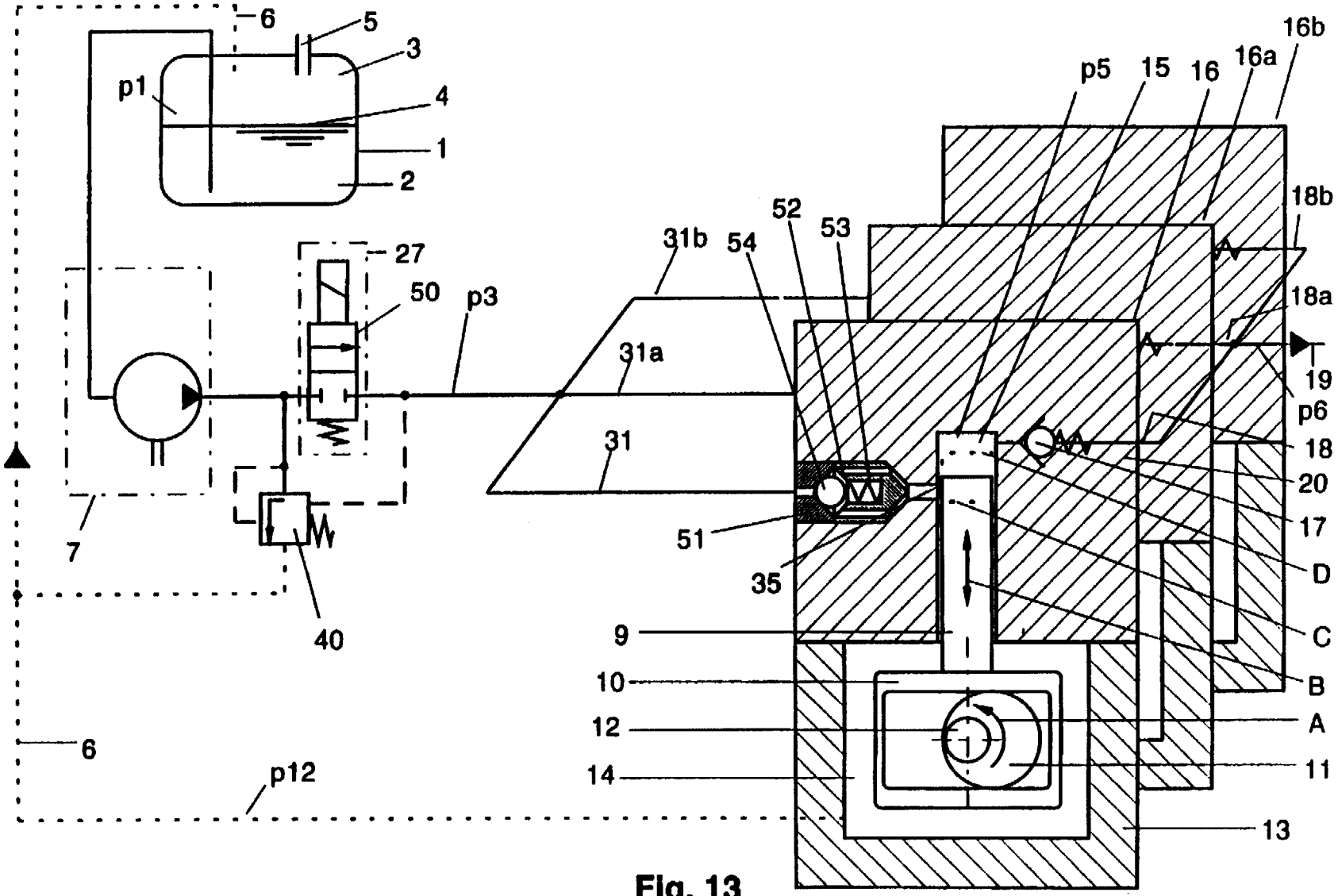
FIG. 13 shows a version according to the invention of a control device with a switching valve as an adjusting device.

FIG. 13 shows an embodiment similar to that of FIG. 3, but with a different design of the throttling 2/2-way valves actuated by pressure difference and with a different type of actuation of the adjusting throttle. The 2/2-way valves of the embodiment according to FIG. 13 each comprise a ball 54 which is pressed on to a valve seat by means of a spring 53. The movement of the ball 54 in relation to the valve seat in the opened state of the valve depends on the pressure p3 prevailing in the respective conduit 31, 31*a* and 31*b*, with the result that the filling of the displacement spaces is controlled in dependence on p3. Whilst a transducer 27 for actuating the adjusting throttle according to FIG. 1 is particularly suitable for incorporating into analog control loops, a switching valve 50 has a transducer according to FIG. 13 has advantages in conjunction with digital electronics.

The illustration of FIG. 13 shows such an arrangement, and, as in FIG. 2, with slit-controlled pumps and with an opening angle adapted to the number of cylinders, a switching valve 50 is sufficient for a plurality of displacement elements 9.

Figure 14:
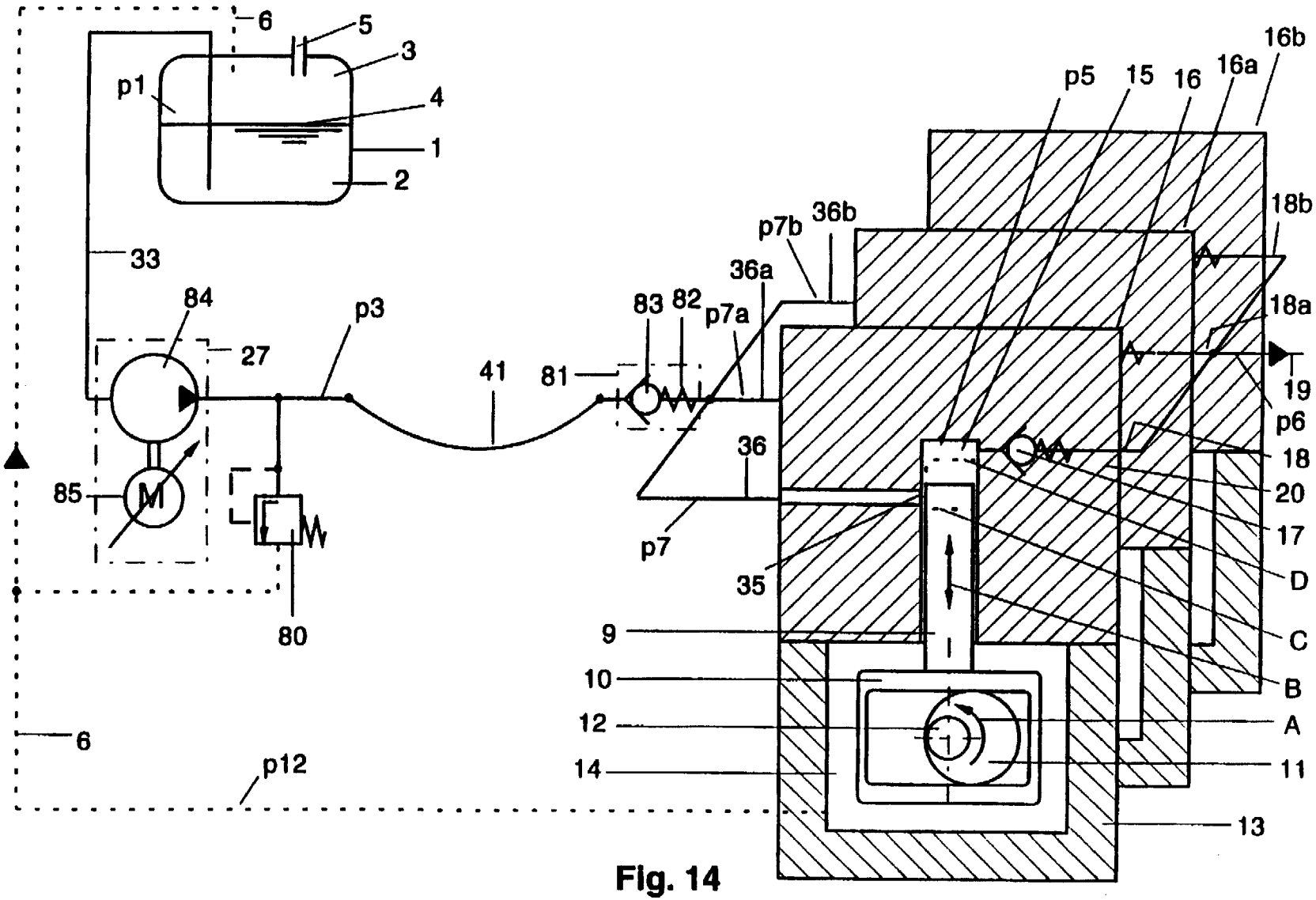
FIG. 14 shows a design according to the invention of a control device for a filling-ratio adjusting pump, in which the adjusting device is formed by a variable displacement machine.

FIG. 14 shows an embodiment in which only one 2/2-way valve 81 is used for, in this example, three displacement spaces, the 2/2-way valve 81 being arranged outside the pump and feeding the individual displacement spaces 15 via conduits 36, 36*a* and 36*b*.

In this example, the adjusting device comprises an adjustable displacement machine 84 acting with a throughflow-limiting function. Preferably, however, the displacement machine 84 is driven by an electric machine of variable rotational speed. The displacement machine is designed as a constant displacement machine and obtains the liquid to be conveyed directly out of the conduit 33 or indirectly out of the liquid reservoir via the system 7. In this case, the pressure-relief valve has the function of a safety valve or blow-off valve. This prevents an inadmissible increase in the pressure difference at the conveying fore-pump, if the latter is adjusted into a position in which it conveys more than the maximum absorption quantity of the main pump.

If, in this example, the throttling 2/2-way valve were not represented as a spring-loaded non-return valve 81, but similarly to the valve 21 in FIG. 2, that is to say as a slide valve without an intended reaction of the pressure $p_4$ on the valve opening, even then specific valve opening would remain if interruptions occurred between the suction phases of the individual displacement elements. In such interruption phases, the pressure $p_4$ rises quickly to the pressure $P_3$, with the result that the proportion of cavities in the channels 7, 7*a*, 7*b* is reduced in each case. Such interruption phases are achieved by selecting the height of the orifice 35 in such a way that the latter is opened by the piston 9 in each case for only less than 360°/number of displacement spaces.

Figure 15:
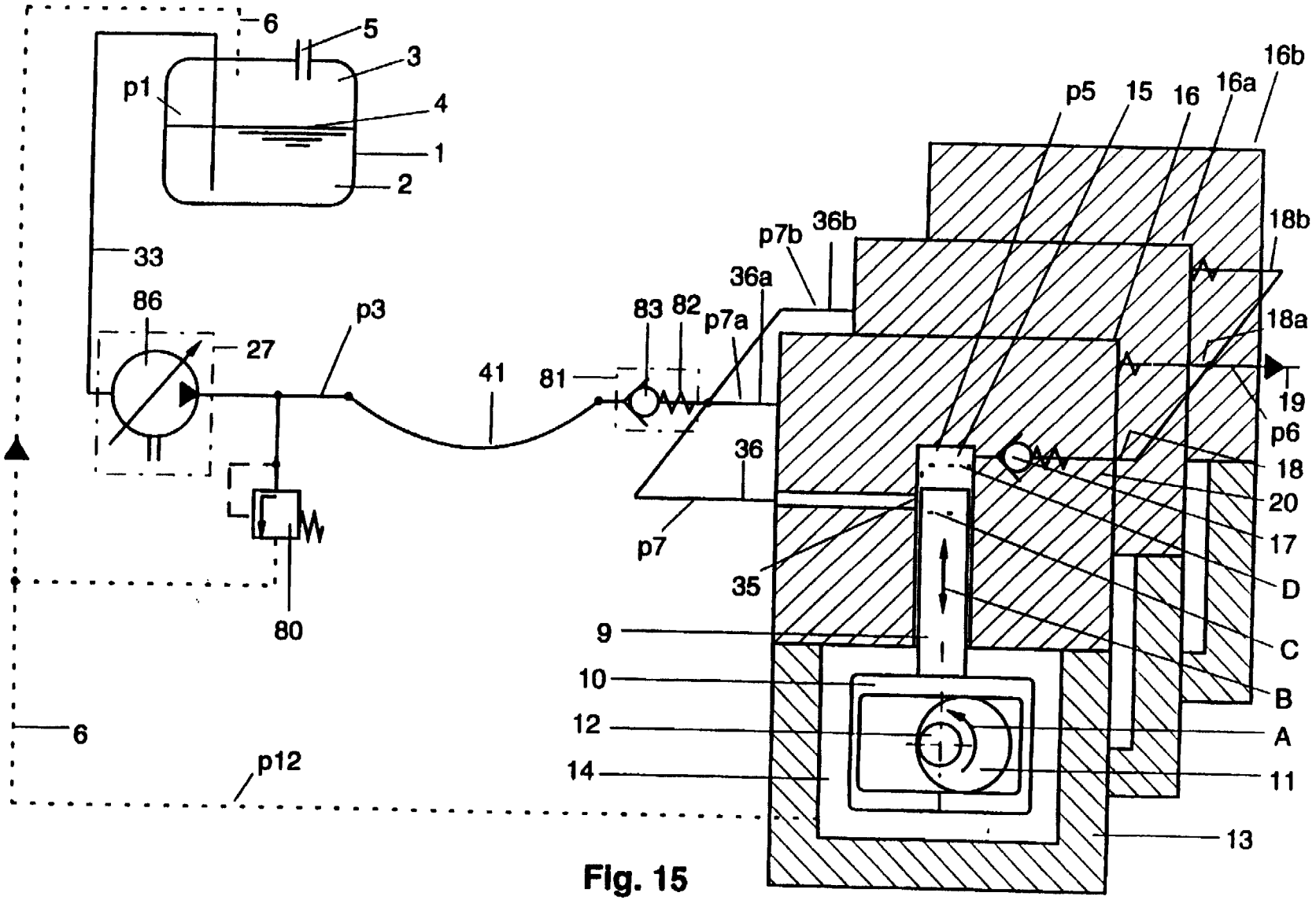
FIG. 15 shows an embodiment similar to that of FIG. 14.

FIG. 15 is very similar to the embodiment of FIG. 14 and likewise makes use of the presence of a regulatable conveying fore-pump, here in the form of the adjustable displacement machine 86, which is driven at the pump rotational speed or at a rotational speed proportional to this. In principle, for example, the drive of the displacement machine 84 can be effected via the drive shaft 12 of the pump.

Figure 16:
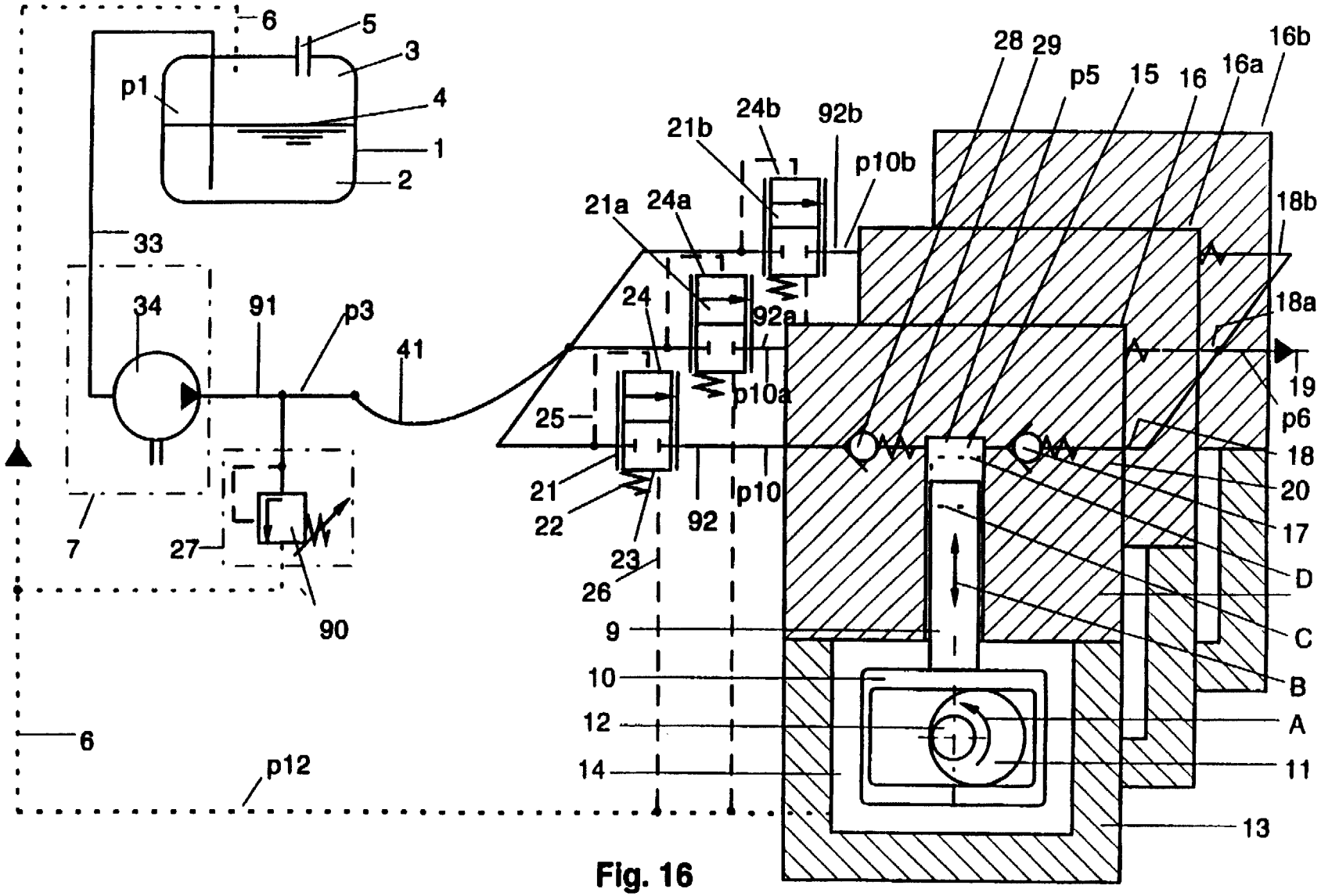
FIG. 16 shows a further version of a control device according to the invention for a filling-ratio adjusting pump, in which an adjustable pressure-relief valve serves as an adjusting device.

FIG. 16 shows an embodiment similar to the embodiment of FIG. 3, in which the conveying fore-pump 34 runs at a constant speed, but in which the control of the inlet pressure takes place by controlling the spring pretension of the pressure-relief valve 90, that is to say the variable pressure-relief valve constitutes the adjusting device.

Figure 17:
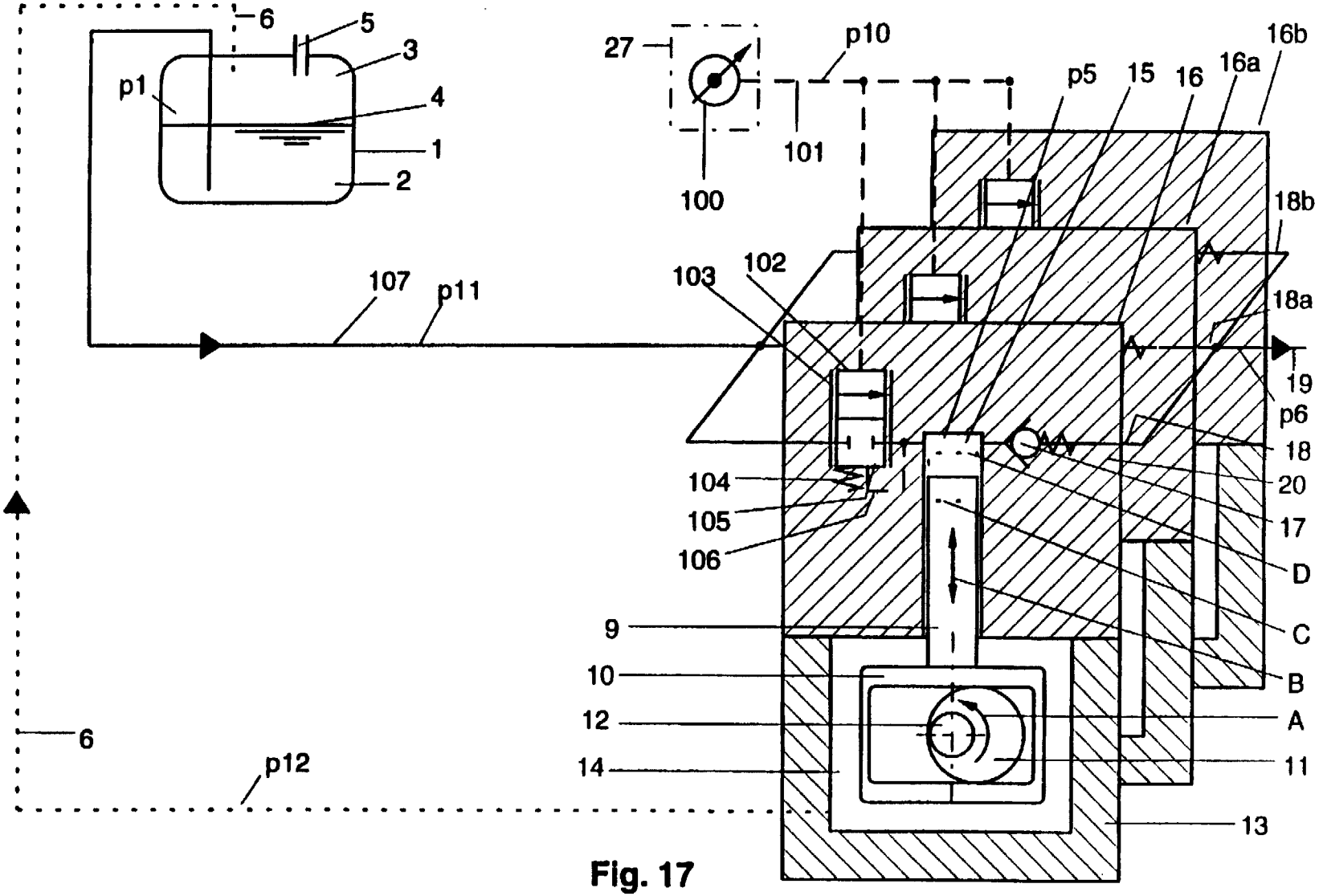
FIG. 17 shows a preferred version of a control device according to the invention for a filling-ratio adjusting pump, in which the adjusting device works with an auxiliary medium, that is to say not with the liquid to be pumped.

FIG. 17 shows a solution which allows a separation of the conveyed liquid from the reservoir and of the actuating medium (but the same fluid is also possible).

This configuration has advantages when the fluid to be conveyed is of very high viscosity or contains impurities which could impair the functioning (Example: common-rail injection system for heavy-oil engines), or when the adjusting pump is to be self-priming or is to be operated only at a very low admission pressure. It is then merely necessary to have a pressure source 100 of substantially lower power for the actuating fluid, such a pressure source frequently being available already (for example, compressed-air network).

The actuating fluid is conducted at the controllable pressure p10 to the individual 2/2-way valves 103 via the conduits 101. In this case, the pressure p10 acts on the effective face 102 on one side of the slide of the 2/2-way valve 103, whilst a spring 104 and the outlet pressure of the 2/2-way valve act via the conduit 106 on the effective face 105 on the other side of the slide 102.

Figure 18:
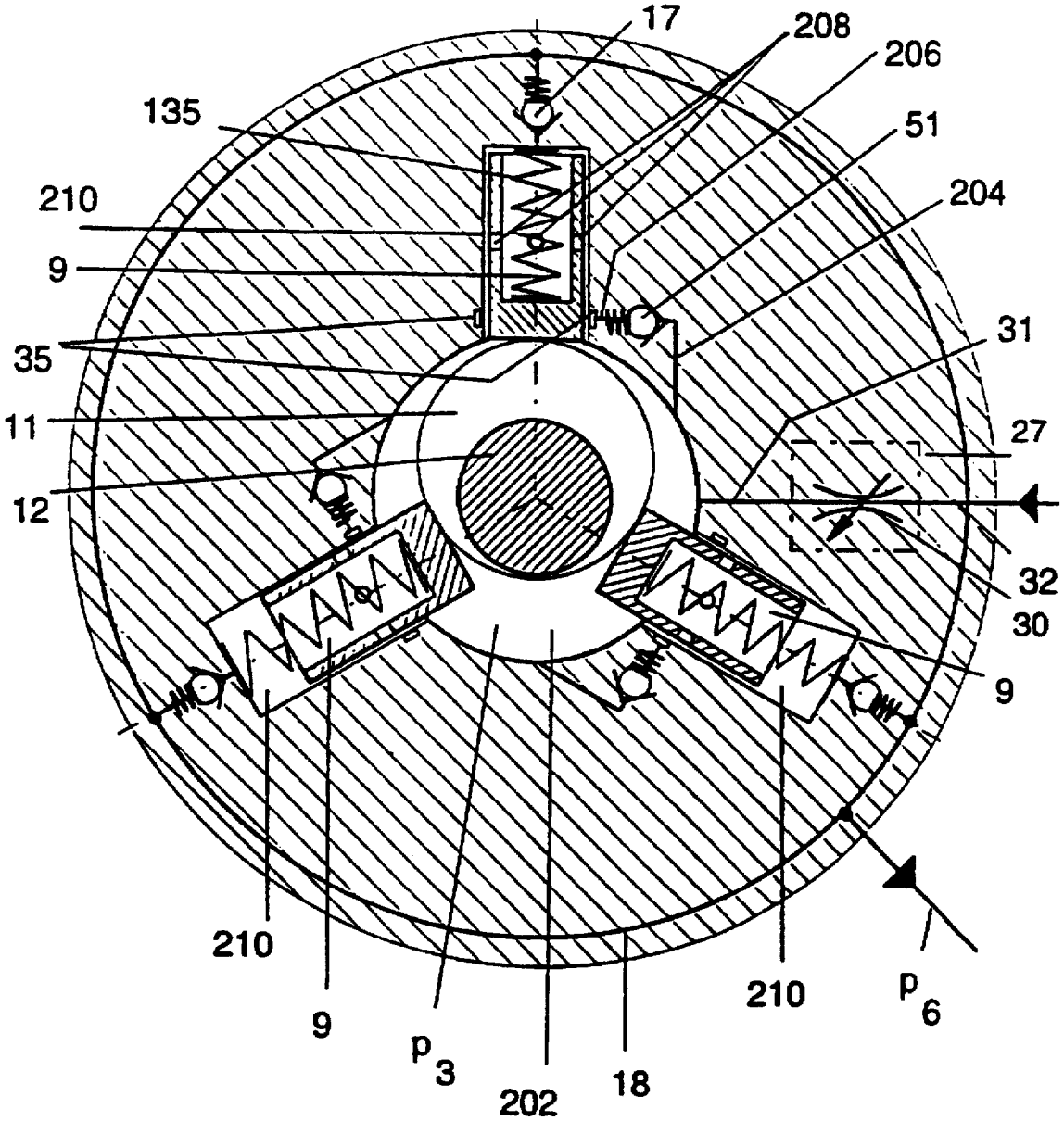
FIG. 18 shows a diagrammatic view of a further filling-ratio adjusting pump according to the invention.

FIG. 18 shows a diagrammatic representation of a pump of the radial type with three displacement pistons 9, only the central part of the pump housing around the drive shaft 12 being shown and only the upper displacement piston 9 being drawn in completely.

As is clear, all three displacement pistons 9 operate with a common eccentric cam 11, which rotates together with the shaft 12.

As is evident from the representation of the upper displacement piston, the latter, like the two further displacement pistons as well, is always held in contact with the eccentric cam 11 via a spring 200. Although in the present drawing all three displacement pistons are driven by the common eccentric cam 11, it would also be possible to offset the displacement pistons in the axial direction of the drive shaft and drive them via separate eccentric cams. Any other number of displacement pistons can also be selected.

An essential feature of the filling-ratio adjusting pump of FIG. 18 is that the liquid to be displaced passes to the individual displacement pistons 9 via the interior and [sic] 202 of the pump housing.

As hitherto indicated, the connecting conduit to the liquid reservoir bears the reference symbol 33. The reference symbol 30 denotes an adjustable throttle element which leads via the conduit 31 into the interior 202. The pump of FIG. 18 is slit-controlled and, for this purpose, has inlet slits 35 (shown only for the upper displacement piston), the inlet slits 35 communicating with the interior 202 in each case via a throttling 2/2-way valve 51 actuated by pressure difference (as shown in FIG. 13) and corresponding conduit portions 204 and 206 in the pump housing. As hitherto, the reference symbol 17 denotes the outlet valve which is combined via a conduit 18 with corresponding conduits of the further displacement pistons 9 (not shown) and which finally leads to the "common rail" of the internal combustion engine connected thereto.

In order to ensure slit control over a corresponding rotary-angle range of the eccentric cam 11, an orifice 208 communicating with the inlet slit 35 and cooperating with the latter in the desired angular range is provided in the displacement piston 9.

When the pump is in operation, the individual displacement pistons 9 are moved to and fro in the respective cylinders 210 by the eccentric cam 11 with the cooperation of the corresponding spring 200. The fuel is thereby sucked through the conduit 33, the throttle 30, the conduit 31, the interior 202, the conduit 206, the 2/2-way valve 51, the conduit 204, the inlet slit 35 the orifice 208 of the displacement piston 9 into the displacement space and subsequently flows out through the outlet valve 17 under the effect of the displacement piston 9.

Due to the relatively large volume of the interior 202, it becomes possible, by means of the invention, to limit the escape of gases in this interior to such an extent that the pump functions perfectly. It should also be pointed out that it is also possible, in this embodiment, to insert (not shown) the 2/2-way valves into the respective displacement piston 9.

LITERATURE (1) Welschof, B.
Analytische Untersuchungen über die Einsatzm öglichkeit einer sauggedrosselten Hydraulik-pumpe zur Leistungssteuerung am Beispiel eines hydrostatischen Nebenaggregateantriebs im Kraftfahrzeug [Analytical investigations on the possibility of using a suction-throttled hydraulic pump for power control by the example of a hydrostatic secondary drive in the motor vehicle] Dissertation RWTH Aachen, 1992

(2) Schneider, W.
Pumpen für zukünftige Dieseleinspritzsysteme O+P (Oelhydraulik und Pneumatik) [Pumps for future diesel injection systems O+P (Oil hydraulics and Pneumatics)] 36 (1992) 5, pages 304–310

(3) Cooper Bessemer Fuel Injection Manual (4) Schneider, W., Stöckli, M., Lutz T., Eberle, M.
Hochdruckeinspritzung und Abgasrezirkulation [High pressure injection and exhaust gas recirculation] MTZ 54 (1993) 11

(5) Schweitzer, P. H., Szebehely, V. G.
Gas Evolution in Liquids and Cavitation Journal of Applied Physics 21 (1950) December, pages 1218–1224

(6) Fassbender, A.
Saugdrosselung—der Einfluf yon Druckmedium und Temperatur [Suction throttling—the influence of pressure medium and temperature] O+P (Oelhydraulikund Pneumatik) [Oil hydraulics and Pneumatics] 37 (1993) 9

(7) Schmitt, Th.
Untersuchungen zur stationären und instationären Str ömung durch Drosselquerschnitte in Kraftstoffeinspritzsystemen von Dieselmotoren [Investigations on stationary and non-stationary flow through throttle cross sections in fuel injection systems of diesel engines] Dissertation TU Munich, 1966

(8) Steuern und Regeln in der Heizungs- und L üftungs-technik, [Control and regulation in heating and ventilation technology], Impulsprogramm Haustechnik [Launch Program Housing Technology] 1986 Publisher: Bundesamt für Konjunkturfragen [Federal Office for Economic Matters], 3003 Berne, Switzerland

I claim:

1. Control device for a positive-displacement pump for liquids, said positive-displacement pump having at least one displacement space and drawing-off a liquid to be conveyed from a liquid reservoir having a free liquid surface which is subjectable to a gas pressure, said control device comprising:

an adjustable flow mechanism limiting the flow of liquid to said at least one displacement space, said adjustable flow mechanism being arranged upstream of said at least one displacement space, at least one throttling 2/2-way valve actuated by a pressure difference and being arranged upstream of said at least one displacement space and downstream of said adjustable flow mechanism, said 2/2-way valve continuously maintaining the pressure in a connecting line between said adjustable flow mechanism and said 2/2-way valve at such a level that emergence of either vapor or dissolved gas from the liquid is prevented, the pressure being at least a pressure of 0.9 bar absolute.

2. Control device according to claim 1, which comprises a pressure source feeding liquid with a sufficiently high pressure arranged upstream of adjustable flow mechanism, said pressure source obtaining the liquid directly or indirectly from said liquid reservoir.

3. Control device according to claim 1, wherein said at least one displacement space is provided with an inlet, said at least one 2/2-way valve being arranged closely upstream of and in proximity with said inlet.

4. Control device according to claim 1, wherein said adjustable flow mechanism comprises one of an electrically, mechanically, hydraulically and a pneumatically adjustable throttling valve.

5. Control device according to claim 1, wherein said adjustable flow mechanism comprises flow-regulating device which includes a throttle valve and a pressure-differential valve.

6. Control device according to claim 1, wherein said adjustable flow mechanism comprises an electrically actuatable pulse-width modulatable 2/2-way switching valve.

7. Control device according to claim 1, wherein said at least one throttling 2/2-way valve includes a spring-loaded valve slide having an active face, said active face being subject to a fluid pressure emanating from a pressure source which is part of a fluid circuit.

8. Circuit device according to claim 1, wherein said at least one throttling 2/2-way valve comprises a spring-loaded inlet valve for said at least one displacement space.

9. Control device according to claim 28, which comprises a damping mechanism acting on said at least one throttling 2/2-way valve.

10. Control device according to claim 2, wherein said at least one throttling 2/2-way valve has a steep opening characteristic and wherein the pressure of the fluid infed to said adjustable flow mechanism is sufficiently high, so that a pressure difference across the adjustable flow mechanism is not appreciably changed even for a maximum pump volumetric flow.

11. Control device according to claim 1, wherein said positive-displacement pump has a plurality of displacement spaces and wherein upstream of said displacement spaces at least one throttling 2/2-way valve is arranged.

12. Control device according to claim 11, wherein one throttling 2/2-way valve is arranged upstream of each of said displacement spaces.

13. Control device according to claim 11, wherein the adjustable flow mechanism comprise a plurality of adjustable throttling valves and which comprises a mechanism synchronously activating at least some of said throttling valves.

14. Control device according to claim 13, which comprises a hollow sliding valve incorporating said plurality of throttling valves, said sliding valve comprising a housing provided with a plurality of chambers and a hollow slide body rotatably or axially displaceably arranged in said housing, wherein said chamber passages are arranged in pairs and are positioned opposite one another in the slide body and the housing.

15. Control device according to claim 14, wherein said passages located opposite one another in the slide body and the housing, respectively, are formed by wire erosion.

16. Control device according to claim 1, which comprises a pump housing, an interior chamber located within said housing, at least one displacement piston, an eccentric cam actuating said at least one displacement piston, and an inlet communicated with said at least one displacement space as well as with said interior chamber, which is in communication with said adjustable flow mechanism, said at least one throttling 2/2-way valve being located either in the pump housing upstream of the inlet or in said displacement piston.

17. Control device according to claim 16, wherein the positive-displacement pump comprises a plurality of displacement spaces and an equal number of displacement pistons, each of said displacement spaces being in communication with said interior chamber via an inlet passage, said adjustable flow mechanism being common to all displacement spaces and being arranged in a line between said liquid reservoir and said interior chamber.

18. Control device according to claim 1 for a positive-displacement pump having a plurality of displacement spaces and an equal number of displacement pistons, each of said displacement spaces being provided with an inlet passage for the liquid to be conveyed, wherein said inlet passages and the correspondingly associated displacement pistons are designed so that the opening phase of the inlet passages is approximately 360° divided by the number of displacement pistons in order to be able to use the adjustable flow mechanism such that the adjustable flow mechanism has only a single flow limiting element.

* * * * *